US007327080B2

(12) United States Patent
DiSanto et al.

(10) Patent No.: US 7,327,080 B2
(45) Date of Patent: Feb. 5, 2008

(54) HYBRID ACTIVE MATRIX THIN-FILM TRANSISTOR DISPLAY

(76) Inventors: Frank J. DiSanto, USA, 27 Par Ct., Manhasset, NY (US) 11030; Denis A. Krusos, USA, 1 Llyod Harbor Rd., Llyod Harbor, NY (US) 11743; Sergey L. Shokhor, Russia, 11 Partridge La., E. Setauket, NY (US) 11733; Alexander Kastalsky, USA, 3 Kenneth Dr., Wayside, NJ (US) 07712; Anthony J. Campisi, USA, 37 Buccaneer La., Setauket, NY (US) 11713

( * ) Notice: Subject to any disclaimer, the term of this patent is extended or adjusted under 35 U.S.C. 154(b) by 307 days.

(21) Appl. No.: 10/974,311

(22) Filed: Oct. 27, 2004

(65) Prior Publication Data

US 2005/0168131 A1 Aug. 4, 2005

Related U.S. Application Data

(63) Continuation-in-part of application No. 10/782,580, filed on Feb. 19, 2004, which is a continuation-in-part of application No. 10/763,030, filed on Jan. 22, 2004, now abandoned, which is a continuation-in-part of application No. 10/102,472, filed on Mar. 20, 2002, now Pat. No. 7,129,626.

(51) Int. Cl.
*H01J 1/62* (2006.01)

(52) U.S. Cl. ..... 313/505; 313/506; 313/509; 313/512

(58) Field of Classification Search ..... 313/503–507, 313/509, 512, 494–496, 498, 499, 491; 315/169.3, 315/169.4
See application file for complete search history.

(56) References Cited

U.S. PATENT DOCUMENTS

| | | | |
|---|---|---|---|
| 3,755,704 | A | 8/1973 | Spindt et al. |
| 5,177,406 | A | 1/1993 | Troxell |
| 5,214,347 | A | 5/1993 | Gray |
| 5,345,141 | A | 9/1994 | Moyer et al. |
| 5,541,478 | A | 7/1996 | Troxell et al. |
| 5,736,814 | A | 4/1998 | Kinoshita et al. |
| 5,955,850 | A | 9/1999 | Yamaguchi et al. |
| 6,023,126 | A | 2/2000 | Karpov |
| 6,590,320 | B1 | 7/2003 | Abanshin et al. |

(Continued)

OTHER PUBLICATIONS

Nano SU-8 Negative Tone Photoresist Formulations 2-25, Micro Chem.

(Continued)

*Primary Examiner*—Tuyet Vo
(74) *Attorney, Agent, or Firm*—Arthur L. Plevy, Esq.; The Plevy Law Firm

(57) ABSTRACT

A field emission display comprises an anode comprising a matrix of pixels and a cathode comprising an insulating layer defining a plurality of wells having a conductor therein. A first conductive layer forms a plurality of conductive pads, each of the conductive pads corresponding to one of the wells. A plurality of nanostructures are electrically coupled to the conductive pads. A second conductive layer is formed over the insulating layer and provides a plurality of gate electrodes. When a potential between the conductive pads and gate electrodes exceeds a threshold voltage, the nanostructures emit electrons that impinge on the pixels.

12 Claims, 20 Drawing Sheets

U.S. PATENT DOCUMENTS

| | | | | |
|---|---|---|---|---|
| 6,614,149 | B2 | 9/2003 | Kastalsky et al. | |
| 6,858,981 | B2 * | 2/2005 | Cho et al. | 313/495 |
| 2002/0134978 | A1 | 9/2002 | Katalsky et al. | |
| 2003/0090190 | A1 * | 5/2003 | Takai et al. | 313/311 |
| 2003/0160745 | A1 * | 8/2003 | Osame et al. | 345/82 |
| 2004/0058153 | A1 | 3/2004 | Ren et al. | |
| 2004/0222734 | A1 | 11/2004 | Oh | |
| 2004/0245937 | A1 * | 12/2004 | Hayashi et al. | 315/169.1 |

OTHER PUBLICATIONS

Teo et al., "Uniform Patterned Growth Of Carbon Nanotubes Without Surface Carbon", Applied Physics Letters, vol. 79, No. 10, Sep. 3, 2001.

Wei et al., "Lift-Up Growth Of Aligned Carbon Nanotube Patterns", Applied Physics Letters, vol. 77, No. 19, Nov. 6, 2000.

Kim et al., Growth And Field Emission Of Carbon Nanotubes On Electroplated Ni Catalyst Coated On Glass Substrates, Journal of Applied Physics, vol. 90, No. 5, Sep. 1, 2001.

Ren et al., "Growth, Characterization, And Potential Applications Of Periodic Carbon Nanotube Arrays".

Fan et al., "Self-Oriented Regular Arrays Of Carbon Nanotubes And Their Field Emission Properties", Science Magazine, vol. 283, Jan. 22, 1999.

C.J. Spindt et al., "9.2: ThinCRT Flat-Panel-Display Construction and Operating Characteristics", SID-98 DIGEST, pp. 99-102, 1998.

C.A. Spindt et al., "A Thin-Film Field-Emission Cathode", Journal of Applied Physics, vol. 39, No. 7, pp. 3504-3505, Jun. 1968.

* cited by examiner

HYBRID ACTIVE MATRIX THIN-FILM TRANSISTOR DISPLAY

RELATED APPLICATIONS

This application is a continuation-in-part of: U.S. patent application Ser. No. 10/763,030, entitled "Hybrid Active Matrix Thin-Film Transistor Display," filed on Jan. 22, 2004 now abandoned, U.S. patent application Ser. No. 10/782,580, entitled "Hybrid Active Matrix Thin-Film Transistor Display," filed on Feb. 19, 2004, and U.S. patent application Ser. No. 10/102,472, entitled "Pixel Structure for an Edge-Emitter Field-Emission Display," filed Mar. 20, 2002 now U.S. Pat. No. 7,129,626, the entire disclosures of each of which are all hereby incorporated by reference herein.

FIELD OF THE INVENTION

This application is related to the field of vacuum displays and more specifically to flat panel displays using Thin Film Transistor (TFT) technology.

BACKGROUND OF THE INVENTION

Flat panel display (FPD) technology is one of the fastest growing technologies in the world with a potential to surpass and replace Cathode Ray Tubes (CRTs) in the foreseeable future. As a result of this growth, a large variety of the FPDs, ranging from very small virtual reality eye tools to large TV-on-the-wall displays, will soon become available. Thin displays will operate with digital signal processing that affords high-definition screen resolution.

Some of the more important requirements of FPDs are video rate of the signal processing; resolution typically above 100 DPI (dots per inch); color; contrast ratios greater than 20; flat panel geometry; screen brightness above 100 candles/meter squared (cd/m$^2$); and large viewing angle.

At present, liquid crystal displays (LCDs) dominate the FPD market. Although significant technological progress has been made in recent years, LCDs still have some drawbacks and limitations that pose considerable restraints. First, LCD technology is rather complex, which results in a high manufacturing cost and price of the product. Other deficiencies, such as small viewing angle, low brightness and relatively narrow temperature range of operation, make application of the LCDs difficult in many high market value areas such as car navigation devices, car computers, and mini-displays for cellular phones.

Other FPD technologies capable of competing with the LCDs are currently under investigation. Among these technologies, plasma displays and field-emission displays (FED) are considered to be the most promising. Plasma displays employ a plasma discharge in each pixel to produce light. One limitation associated with plasma displays is that the pixel cells for plasma discharge cannot be made very small without affecting neighboring pixel cells. This is why the resolution in plasma FPD is poor for small format displays and becomes more efficient as the display size increases above 30" diagonally. Another limitation associated with plasma displays is that they tend to be thick as compared to FPDs. A typical plasma display has a thickness of about 4 inches. Further, they tend to be heavy and generate high temperatures.

Field Emission Displays (FEDs), on the other hand, employ "cold cathodes" which produce mini-electron beams that activate phosphor layers in the pixel. It has been predicted that FEDs will replace LCDs in the future. Currently, many companies are involved in FED development. However, after ten years of effort FEDs are not yet in the market.

FED mass production has been delayed for several reasons. One of these reasons concerns the fabrication of the electron emitters. The traditional emitter fabrication is based on forming multiple metal (Molybdenum) tips, see C. A. Spindt "Thin-film Field Emission Cathode," Journal. Of Appl. Phys., v. 39, 3504, and U.S. Pat. No. 3,755,704 issued to C. A. Spindt. The metal tips concentrate an electric field, activating a field-induced auto-electron emission to a positively biased gate. The anode contains light emitting phosphors which produce an image when struck by an emitted electron. The technology for fabricating the metal tips, together with necessary controlling gates, is rather complex. This fabrication process requires sub-micron, electron-beam lithography and angled metal deposition in a large base electron-beam evaporator.

Another difficulty associated with FED mass production relates to the lifetime of FEDs. Electrons striking the phosphors result in phosphor molecule dissociation and formation of gases, such as sulfur oxide and oxygen, in the vacuum chamber. The gas molecules reaching the tips cloud or shield the electric field resulting in a reduction of the efficiency of electron emission from the tips. A second group of gases, produced by electron bombardment, contaminates the phosphor surface and forms undesirable energy band bending at the phosphor surface. This prevents electron-hole diffusion from the surface into the depth of the phosphor grain resulting in a reduction of the light radiation component of electron-hole recombination from the phosphor. These gas formation processes are interrelated and directly connected with vacuum degradation in the display chamber.

The gas formation processes are most active in the intermediate anode voltage range of 200-1000V. If, however, the voltage is elevated to 6-10 kV, the incoming electrons penetrate deeply into the phosphor grain. In this case, the products of phosphor dissociation are sealed inside the grain and cannot escape into the vacuum. This significantly increases the life time of the FED and makes it close to that of a conventional cathode ray tube.

The high anode voltage approach is currently accepted by all FED developers. This, however, creates another problem. To apply such a high voltage, the anode must be made on a separate substrate and removed from the emitter a significant distance equaling about 1 mm. Under these conditions, the gate controlling efficiency decreases, and pixel cross-talk becomes a noticeable factor. To prevent this effect, an additional electron beam focusing grid is introduced between the first grid and the anode, see, e.g., C. J. Spindt, et al., "Thin CRT Flat-Panel-Display Construction and Operating Characteristics," SID-98 Digest, p. 99, which further complicates display fabrication.

Some existing tip-based FEDs include an additional electron beam focusing grid. Such FEDs include an anode, a cathode having a plurality of metal tip-like emitters, and a control gate made as a film with small holes above the tips of the emitters. The emitter tips produce mini-electron beams that activate phosphors coated on the anode. The phosphors are coated with a thin film of aluminum. The metal tip-like emitters and holes in the controlling gate, which are less than 1 μm in diameter, are expensive and time consuming to manufacture, hence they are not readily suited for mass production.

Another approach to FED emitter fabrication involves forming the emitter in the shape of a sharp edge to concentrate the electric field. See U.S. Pat. No. 5,214,347 entitled "Layered Thin-Edge Field Emitter Device" issued to H. F. Gray. The emitter described in this patent is a three-terminal device for operation at 200V and above. The emitter employs a metal film, the edge of which operates as an emitter. The anode electrode is fabricated on the same substrate, and is oriented normally to the substrate plane, making it unsuitable for display functions. A remote anode electrode is provided parallel to the substrate, making it suitable for display purposes. The anode electrode, however, requires a second plate which significantly complicates the fabrication of the display.

Still another approach to FED emitter fabrication can be found in U.S. Pat. No. 5,345,141, entitled "Single Substrate Vacuum Fluorescent Display," issued to C. D. Moyer, et al., which relates to the edge-emitting FED. The pixel structures described in U.S. Pat. No. 5,345,141 include a diamond film deposited on top of a metal film and only the diamond edge is exposed. Thus, only a relatively small fringing electric field coming from the metal film underneath the diamond film contributes to the field emission process.

Another limitation of FEDs is that the emitter films, including the diamond film and the insulator film, are grown on a phosphor film. The phosphor film is known to have a very rough surface morphology that makes it unsuitable for any further film deposition.

A pixel structure that reduces some of the noted problems with current FED technology is disclosed in commonly-assigned, co-pending, U.S. patent application Ser. No. 10/102,472, entitled "Pixel Structure for an Edge-Emitter Field-Emission Display," filed Mar. 20, 2002. This application depicts an FED pixel that eliminates emitter tips in the FED cathode. In this application, electrons are emitted from the edges of electron emitting materials, such as alpha-carbon.

Although the pixel structure disclosed in the above-noted co-pending application reduces some of the problems, there is a need for a FED pixel design which substantially eliminates the problems associated with FED fabrication and allows for mass production of same.

SUMMARY OF THE INVENTION

A field emission display comprises an anode comprising a matrix of pixels and a cathode comprising an insulating layer defining a plurality of wells having a conductor therein. A first conductive layer forms a plurality of conductive pads, each of the conductive pads corresponding to one of the wells. A plurality of nanostructures are electrically coupled to the conductive pads. A second conductive layer is formed over the insulating layer and provides a plurality of gate electrodes. When a potential between the conductive pads and gate electrodes exceeds a threshold voltage, the nanostructures emit electrons that impinge on the pixels.

Figure 1:
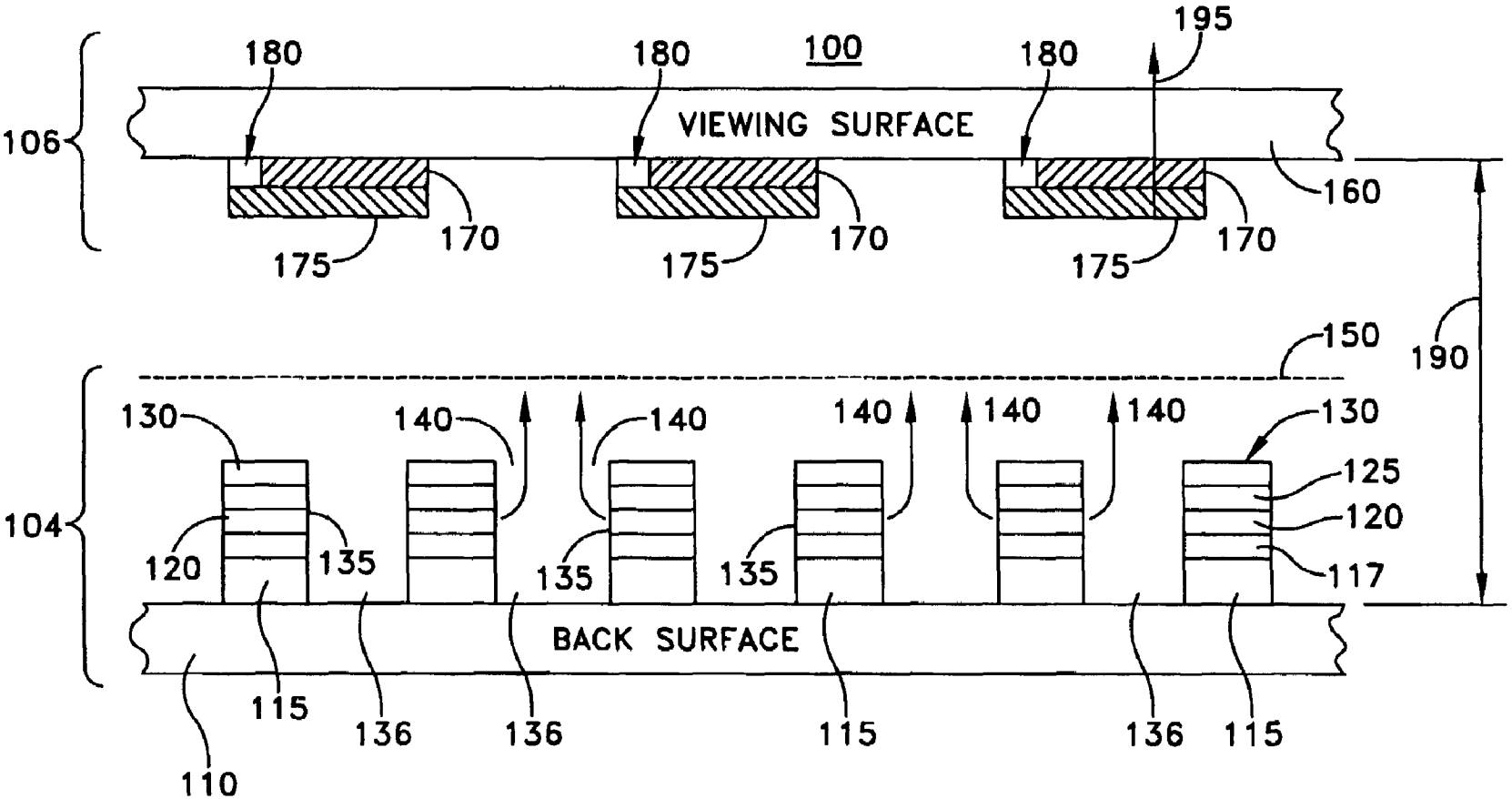
FIG. 1 illustrates a cross-sectional view of a TFT anode-based Field Emission Display (FED) in accordance with the principles of the invention.

It is to be understood that these drawings are solely for purposes of illustrating the concepts of the invention and are not drawn to scale. The embodiments shown herein and described in the accompanying detailed description are to be used as illustrative embodiments and should not be construed as the only manner of practicing the invention. Also, the same reference numerals, possibly supplemented with reference characters where appropriate, have been used to identify similar elements.

DETAILED DESCRIPTION OF THE PREFERRED EMBODIMENTS

According to an aspect of the present invention, vacuum flat panel display using thin-film-transistor (TFT) circuit may be provided. Associated with each pixel element is a TFT circuit comprising first and second active devices electrically cascaded and a capacitor in communication with an output of the first device and an output of the second device that may be used to selectively address pixel elements in the display. Cold cathode sources are used to emit electrons that are drawn to selected pixel elements that include phosphor pads, which emit light of a known wavelength when struck by the emitted electrons.

FIG. 1 illustrates a cross-sectional view of a TFT anode/cold cathode Field Emission Display (FED) element 100 in accordance with the principles of the present invention. In this exemplary embodiment, the display element 100 is composed of cathode 104 that acts as a low-voltage source of electrons, anode 106 that employs TFT technology to control the attraction of electrons 140 to corresponding pixel elements on the surface 160, and grid 150 between anode 106 and cathode 104 that serves to accelerate electrons to the anode 106.

Cathode 104 is fabricated by progressively depositing onto substrate 110, conventionally a glass, an insulating material 115, a conductive material 117, an emitter material 120 operable to emit electrons, a second insulating layer 125, such as $SiO_2$, and a second conductive material 130. Emitter material 120 is selected from known materials that have a low work function for emitting electrons 140. Alpha-carbon is a well-known material for emitting electrons 140. The conductive material 117 beneath the emitter material 120 serves to reduce the resistance of the emitting layer and thus bring the emitter voltage to the edge 135 of emitter material 120. Wells 136 are then etched through the deposited second conductive layer 130, insulating layer 125, emitter layer 120, conductive layer 117 and insulating layer 115 using well-known photoetching methods. In this case, edges 135 of the emitter material 120 are exposed for the generation of electrons 140. Second conductive material 130 operates as a gate to draw electrons 140 from the edges 135 of emitter material 120 when a sufficient potential difference, i.e., electron extraction voltage or threshold voltage, exists between conductive material 130 and conductive layer 117.

Anode 106 is composed of a plurality of conductive pads 170 fabricated in a matrix of substantially parallel rows and columns on surface 160 using known fabrication methods. In this illustrated embodiment material 160 is a transparent material such as glass. Conductive pads 170 are also composed of a transparent material, such as ITO (Indium Titanium Oxide).

Figure 2:
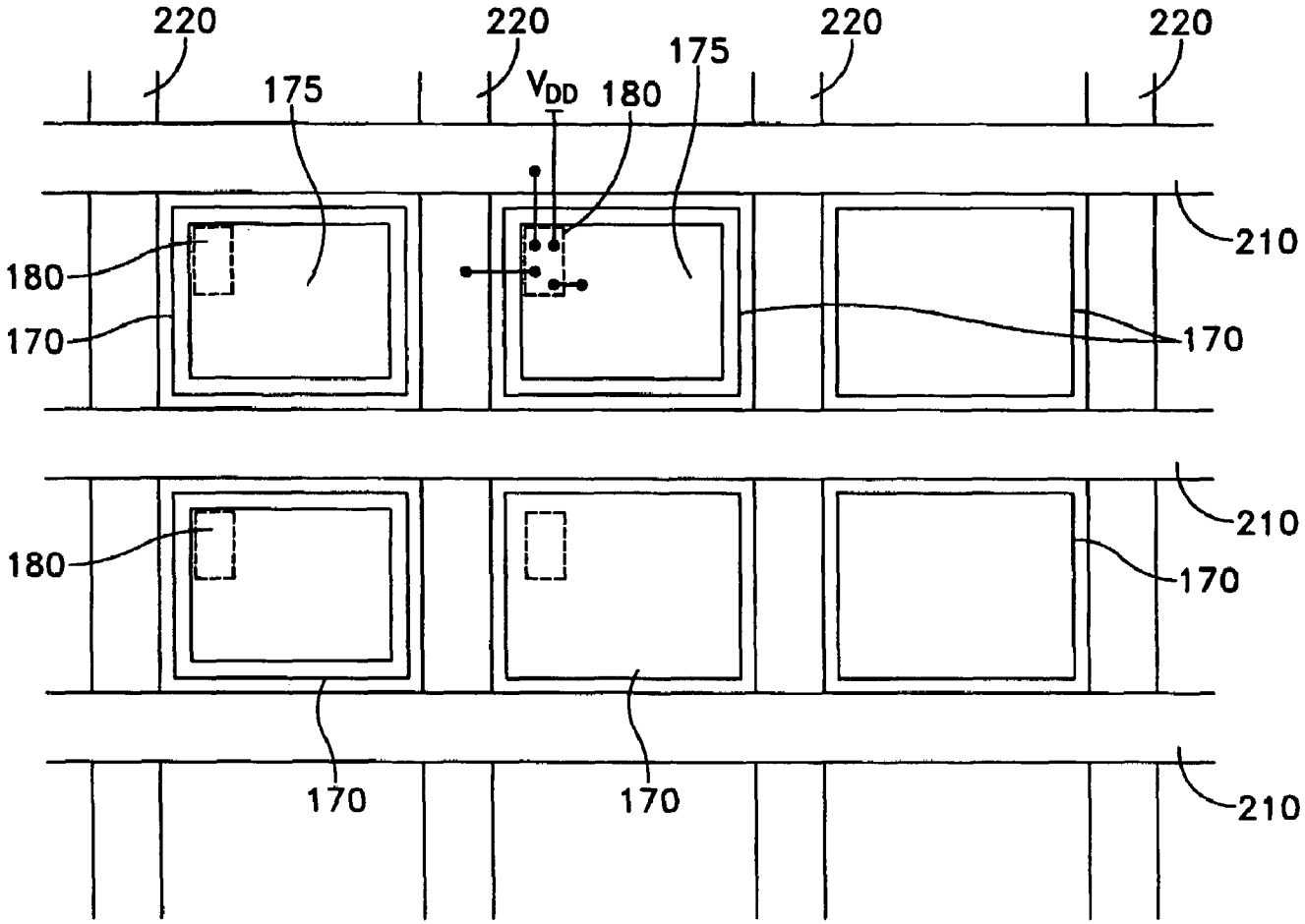
FIG. 2 illustrates a top view of an embodiment of a TFT anode used in the present invention.

A matrix organization, as will be shown in FIG. 2, of conductive pads 170 and phosphor layers 175 allows for known X-Y addressing of each of the conductive pads 170. In this case, conductive pad 170 may be representative of individual pixel element in the display.

Deposited on each conductive pad 170 is phosphor layer 175. Phosphor layer 175, in one aspect of the invention, may be selected from materials that emit photons 195 of a specific color for a monochrome display. In a conventional RGB display, phosphor layer 175 may be selected from materials that produce red light, green light or blue light 195 when struck by electrons 140. As would be appreciated by those skilled in the art, the terms "light" and "photon" are synonymous and are used interchangeably herein.

Associated with each conductive pad 170/phosphor layer 175 pixel element is a TFT circuit 180 that is operable to apply a known voltage to an associated conductive pad 170/phosphor layer 175 pixel element. TFT circuit 180 operates to apply either a first voltage to bias an associated pixel element to maintain it in an "off" state or a second voltage to bias an associated pixel element to maintain it in an "on" state, i.e., activate. In one embodiment, TFT circuit 180 may apply a zero voltage, Va=0, to bias conductive pad 170 into an "off" state, or apply a higher positive bias voltage, in the order of Va=25-30 volts, to bias conductive pad 170 into an "on" state. In this illustrated case, conductive pad 170 is inhibited from attracting electrons 140 emitted by cathode 104 when in an "off" state, and attracts electrons 140 when in an "on" state.

The use of TFT circuitry 180 for biasing conductive pad 170 provides for the dual function of addressing pixel elements and maintaining the pixel element in a condition to attract electrons for a desired time period, i.e. time-frame or sub-periods of time-frame, as will be explained more fully with regard to FIGS. 2 and 3.

In the embodiment shown in FIG. 1, grid 150 is interposed, relatively equidistant, between cathode 104 and anode 106. Grid 150, having a plurality of grid holes 152, smaller than the cathode-to-anode distance 190, unifies the electron distribution in front of the anode plane. In one aspect, electrons 140 emitted by cathode 104 pass through grid 150 and impinge upon phosphor pad 175 when a corresponding conductive pad 170 is biased to an "on" state. Similarly, electrons are not attracted to the conductive pad 170 when a corresponding conductive pad 170 is biased to an "off" state.

It would be recognized by those skilled in the art that the role of a positively biased grid 150 is advantageous as it serves to unify the electron distribution in front of the phosphor pads. This operation is applicable when the electron energies are small and can be controlled by the potentials applied to the TFT circuitry. For example, when gate voltage for extracting electrons is less than the TFT control voltage, i.e., anode voltage, grid 150 may not be necessary.

However, in another aspect, when the gate voltage for electron extraction from emitter edge 135 is higher than voltage applied to the anode, i.e., phosphor pads 170, via the TFT circuitry, the energies of electron 140 may be too high and not manageable by the relatively low TFT voltages. In this case, grid 150 may be used to decelerate the electrons approaching the phosphor pads by lowering the voltage applied to grid 150.

Although grid 150 is shown in this exemplary embodiment and has been discussed with regard to controlling emitted electrons, it would be recognized that the operation of display 100 is not dependent upon the presence of grid 150 and the embodiment shown in FIG. 1 represents an exemplary embodiment of the invention.

The TFT FED 100 shown allows for a low voltage addressing on the anode and the use of inexpensive LCD drivers. Furthermore, the addressing circuit (not shown) on anode 106 eliminates the need for electron beam focusing methods necessary in conventional FED structures. The use of low voltage further eliminates problems of gas ionization and chamber breakdown characteristically associated with the use of high voltage FEDs. Furthermore, cathode 104 serves as a uniform electron source and provides for high screen brightness and uniformity. The separation of pixel control circuitry from cathode 104 is further advantageous as it makes the fabrication of the device simpler and increases the fabrication yield.

FIG. 2 illustrates a top view of an exemplary TFT-based anode. In this illustrated example, anode 200 is organized in a matrix of electrically conductive rows, referred to as 210, and electrically conductive columns, referred to as 220, electrically insulated from each other. Associated with each row/column is an electrically conductive pad or area 170 and phosphor pad 175 that defines a pixel element. As would be appreciated, phosphor pad 175 is substantially adjacent to the conductive area 170 and TFT 180 is thus shown using dashed lines to indicate that it is located beneath phosphor pad 175.

Associated with each conductive pad 170/phosphor pad 175 and accessed by a row/column designation is TFT circuit 180. TFT circuit 180 operates to electrically disconnect an associated conductive pad 170/phosphor pad 175 when the associated pixel is intended to be in an "off" state and connect an associated conductive pad 170/phosphor pad 175 when it is intended to be in an "on" state. A known voltage, referred to as $V_{dd}$, is applied to each TFT circuit 180.

Figure 3:
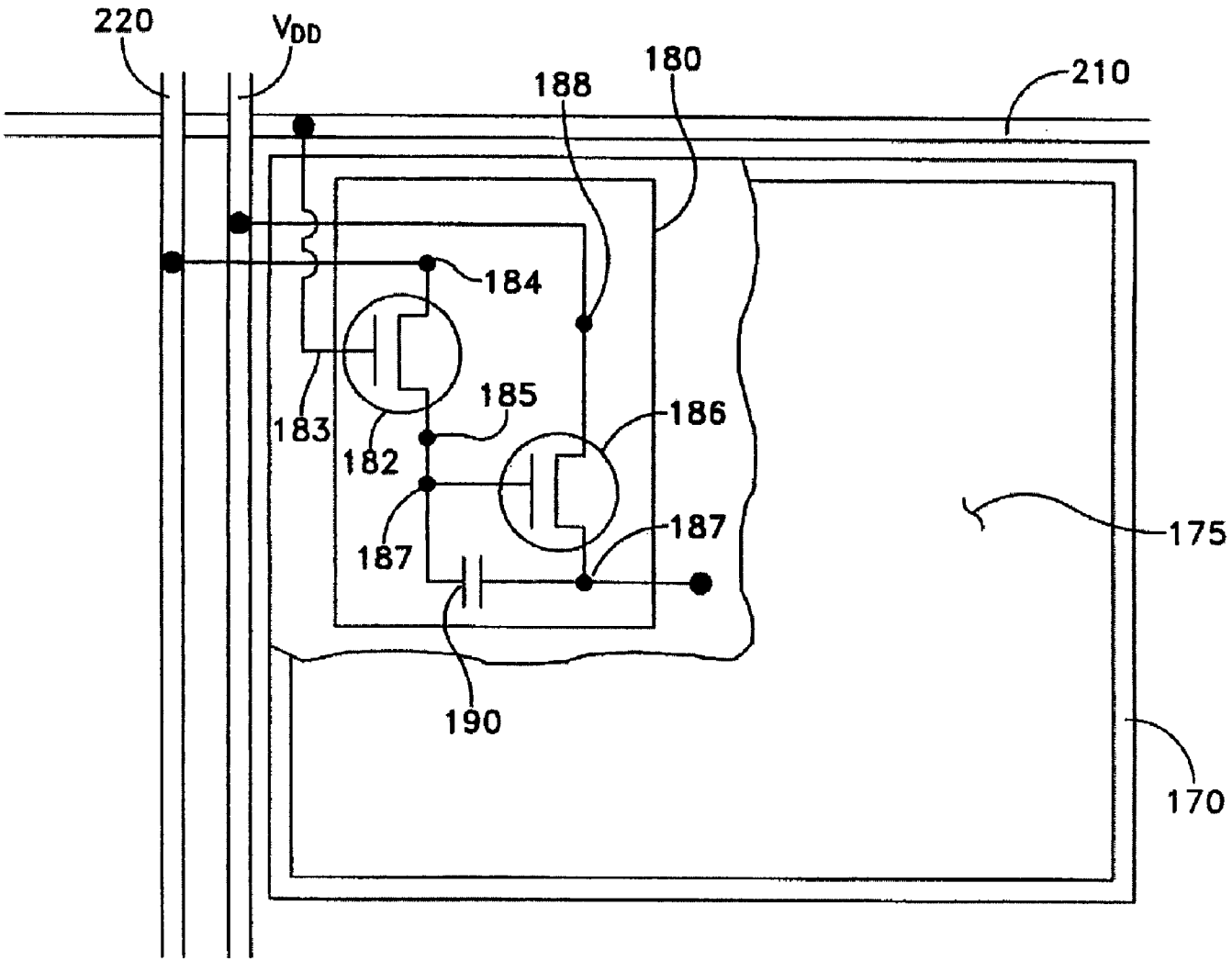
FIG. 3 illustrates a circuit diagram of a TFT circuit used in the present invention.

FIG. 3 illustrates a circuit diagram of a TFT circuit 180 associated with a single element in the matrix shown in FIG. 2. In this illustrated embodiment, phosphor pad 1754 is shown cut-away to reveal the details of TFT circuit 180. TFT circuit 180 is composed of two transistor devices 182, 186, electrically cascaded, and capacitor 190 connected between the output of first device 182 and the output of second device 186. In the illustrated embodiment, devices 182,186 are FETs (Field Effect Transistors). FETs are known in the art to possess a high input impedance.

In the illustrated embodiment, gate node 183 of FET 182 is electrically connected to and associated with row line 210, and node 184 of FET 182 is associated with column line 220. The output node 185 of FET 182 is electrically cascaded to gate electrode 187 of FET 186, and to capacitor 190.

Electrode 188 of FET 186 is electrically connected to constant voltage source, typically $V_{dd}$, and output electrode 189 is electrically connected to electrically conductive pad 170. Capacitor 190 is also further connected between the gate and the source node of FET 186.

In operation, when FET 182 is in an "on" state, by the application of a voltage on row line 210, a voltage applied to column line 220 is passed through FET 182 and concurrently present at, or applied to, gate node 187 of FET 186 and capacitor 190. Capacitor 190 is charged to substantially the same voltage value as applied to column 220. When voltage on row line 210 is removed, capacitor 190 operates to substantially maintain the same potential as is on column line 220 to gate electrode 187. This voltage is maintained for a known period of time, which is based on the value of capacitor 190 and an impedance of FET 182. Capacitor 190 thus operates to substantially "hold" the voltage even after the voltage or potential to selected row 210 is removed.

As voltage or potential is applied to gate terminal 187 of FET 186, FET 186 is in an "on" state and the constant, fixed voltage or potential, $V_{dd}$, applied to node 188, which is also referred to as an anode voltage ($V_a$), is passed through FET 186 to node 189 and associated pad 170. Pad 170 then is operable to attract electrons 140 (not shown) drawn from cathode 104. When the gate electrode 187 voltage is removed, the corresponding pixel is switched to an "off" state as the potential at electrode 189 is relatively low, i.e., near zero volts. In one aspect of the invention, the anode voltage may be in the range of about 20-30 volts.

Thus, TFT circuit 180 provides for both "pixel selection" and "pixel hold" functions. Accordingly, electrons 140 may continue to be attracted to the corresponding phosphor layer 175 for a desired time frame without the concurrent application of a voltage on a corresponding row line.

Capacitor 190 is sized to be commensurate with the desired frame time and the input impedance of the second active device 186. The value of capacitor 190 may be selected such that the decay of the stored charge through the impedance of first device 182 is in the order of or larger than the desired frame time.

Returning to FIG. 2, although the exemplary display matrix has been described as a monochromatic display having six pixel elements, those skilled in the art should readily recognize that FIG. 2 may also represent a color display having three color pixels with each color pixel having associated red, green and blue phosphor layers. While the present color display is described with the use of conventional RGB (red, green, blue) technology, the use of phosphor layers that emit light of alternate colors, visible and non-visible, is considered within the scope of the invention.3

Figure 4:
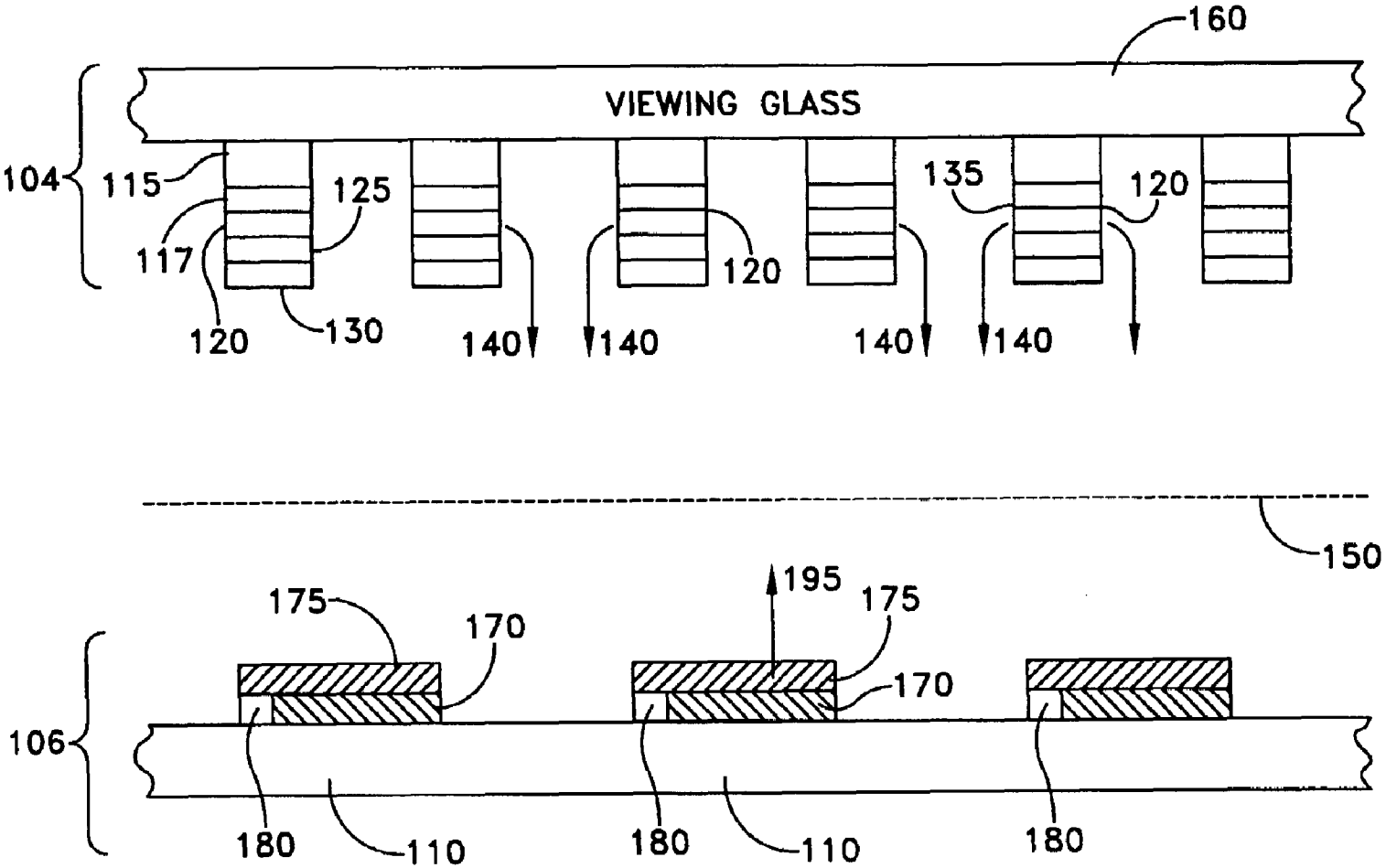
FIG. 4 illustrates a cross-sectional view of a second embodiment of a TFT anode-based FED in accordance with the principles of the present invention.

FIG. 4 illustrates a second embodiment of the display. In this embodiment, the TFT anode structure shown in FIG. 2 is deposited on substrate 110. In this case, a material such as poly-silicon or amorphone silicon, may be deposited on substrate 110, that allows for the fabrication of row lines 210 (not shown), column lines 220 (not shown), conductive pad 170 and TFT circuit 180 onto substrate 110 in row/column matrix as shown in FIG. 2. Phosphor layer 175 may then be deposited on corresponding conductive pads 170.

In one aspect a silicon (Si) single crystal wafer may be used for the active matrix circuitry, wherein the Si wafer is attached to a glass substrate. In this case, the phosphor pads are also made on the Si wafer.

Cathode 104 is fabricated on viewing surface 160 and emitter layer 120 and conductive layer 130 operate to draw electrons from edges 135 of emitter layer 120. Emitter layer 120 and conductive layer 130 occupy a significantly small portion of the viewing glass area to allow for photons to be viewed through cathode 104 and transparent viewing glass 160. As would be appreciated, elements of cathode 104 may be composed of optically transparent materials.

As in the embodiment shown in FIG. 1, grid 150 may have a dual function in both unifying the electron distribution approaching the phosphor pads and decelerating the electron. This latter function may be needed when the threshold voltage for electron extraction from the emitter edge is too high to be controlled by the voltages on the TFT circuit.

Figure 5:
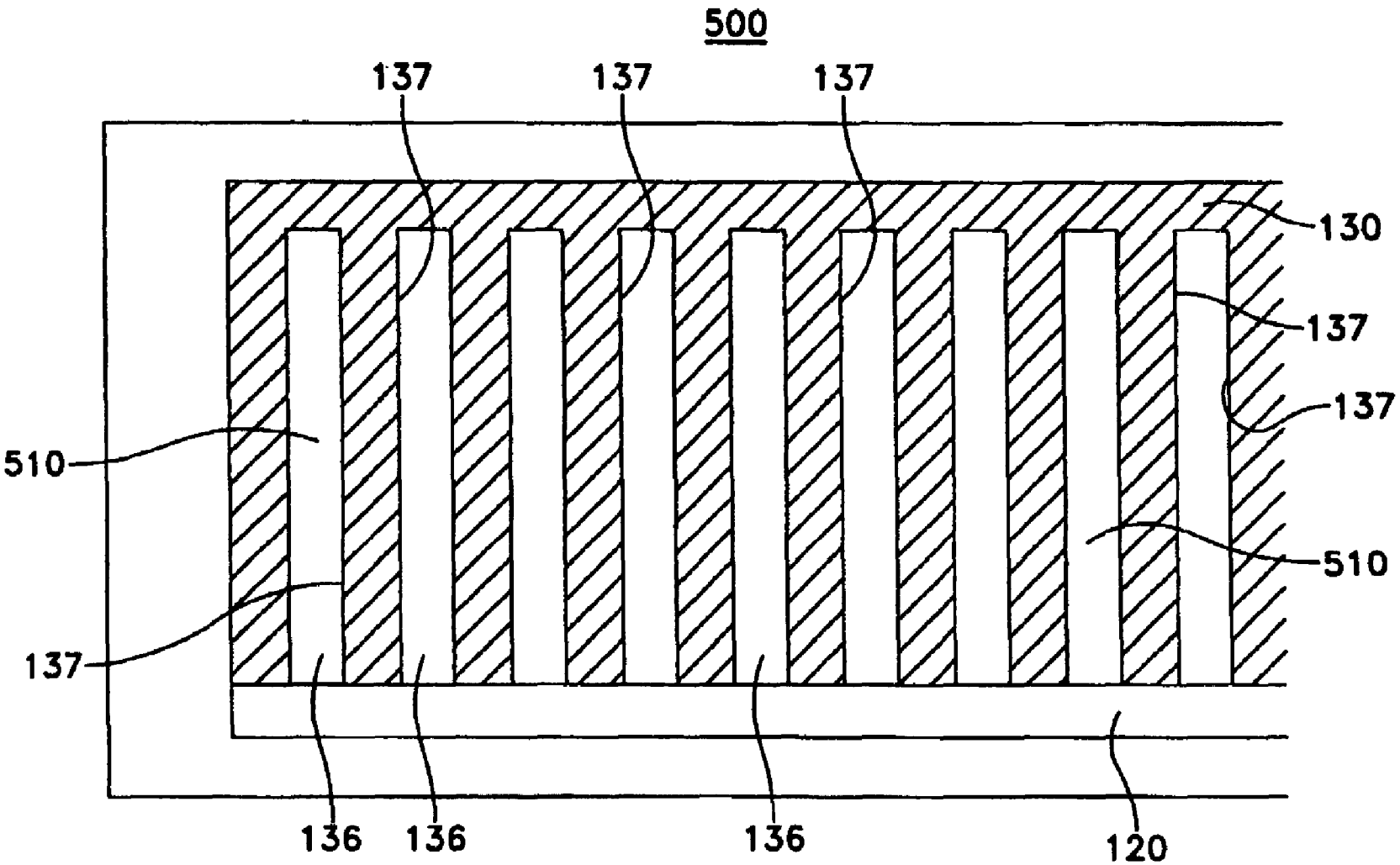
FIG. 5 illustrates a top view of an exemplary FED cathode in accordance with the principles of the present invention.

FIG. 5 illustrates a top view of an exemplary cathode 104 in accordance with the principles of the invention. It is desired that cathode 104 serves as a uniform electron source when the voltage applied to conductive layer 130 is sufficiently positive relative to emitter layer 120. In this exemplary embodiment, wells 136 are formed within the conductive layer 130 as elongated slots 510, which increase the length of emitter edges 135 (not shown). Increased emitter edge 135 length provides for an increased edge area for the emission of electrons 140.

In this exemplary view, wells 136 are etched through conductive layer 130 to expose the emitter layer edges. Edges 135 (not shown) of emitter layer 120 are formed beneath edges 137 of conductive layer 130.

Figure 6:
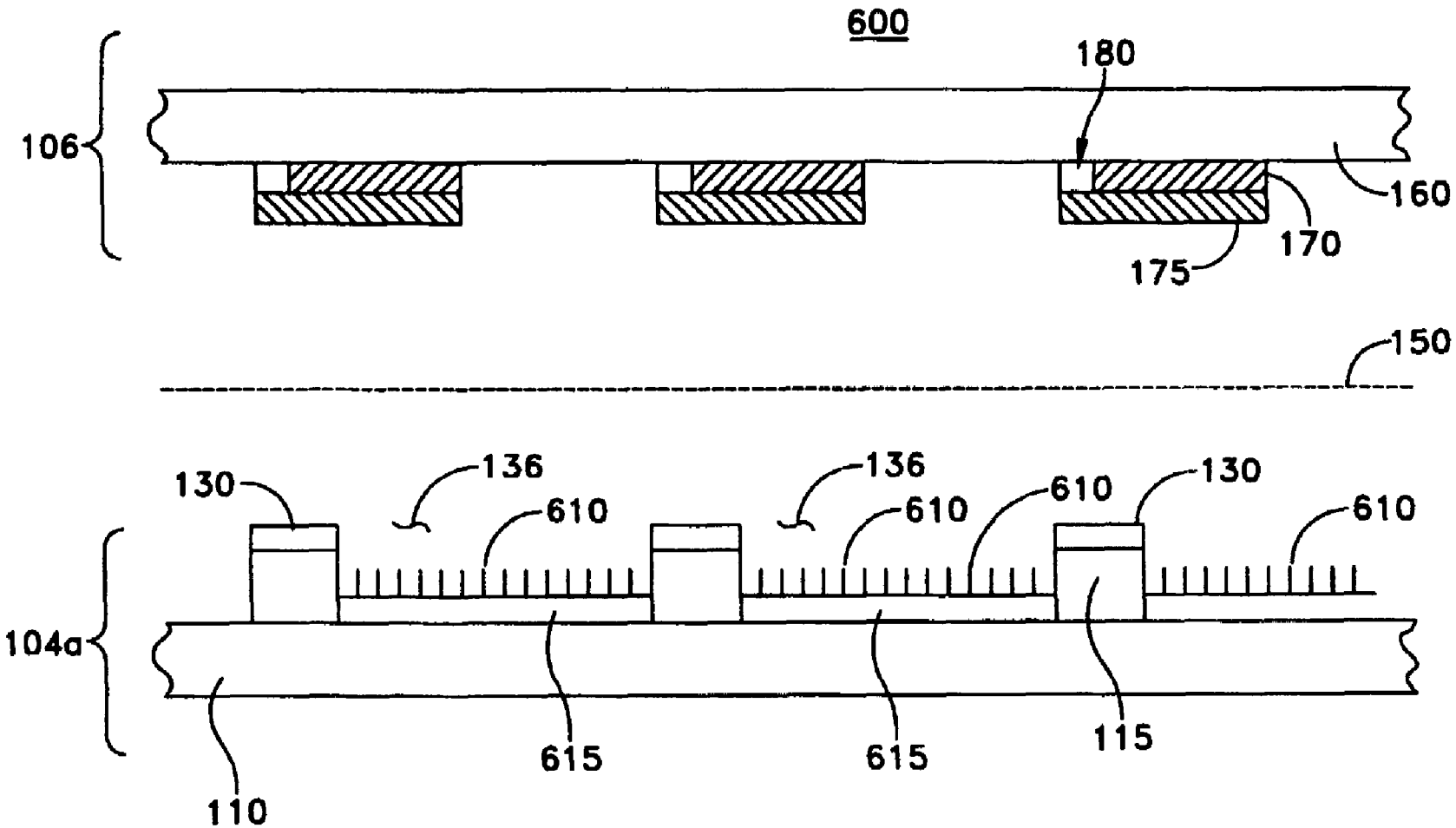
FIG. 6 illustrates a cross-section view of another embodiment of the TFT based display shown in FIG. 1 using an alternate cold cathode configuration.

FIG. 6 illustrates another exemplary embodiment of a TFT based display 600 wherein cathode 104*a* is composed of a plurality of carbon nanotubes 610 placed on conductive material 615 located within well 136. In this case, conductive layer 130, electrically isolated from material 615, operates as a gate that may be used to draw electrons 140 from nanotubes 610, when the potential difference between gate 130 and nanotube 610 exceeds a threshold for electron extraction. Nanotubes 610 are known to possess extremely low threshold voltages in the order of 1-3 V/micron for electron emission. Cataphoretic deposition or printing of nanotubes 610, as well as nanotube growth on a metal surface are known in the art.

Similar to the design shown in FIG. 1, grid 150 is also shown in this exemplary embodiment to control and decelerate, if necessary, the flow of electrons 140 directed toward phosphor layer 175. Anode 106 is similar to that described with regard to FIG. 1 and its description need not be repeated.

Figure 7:
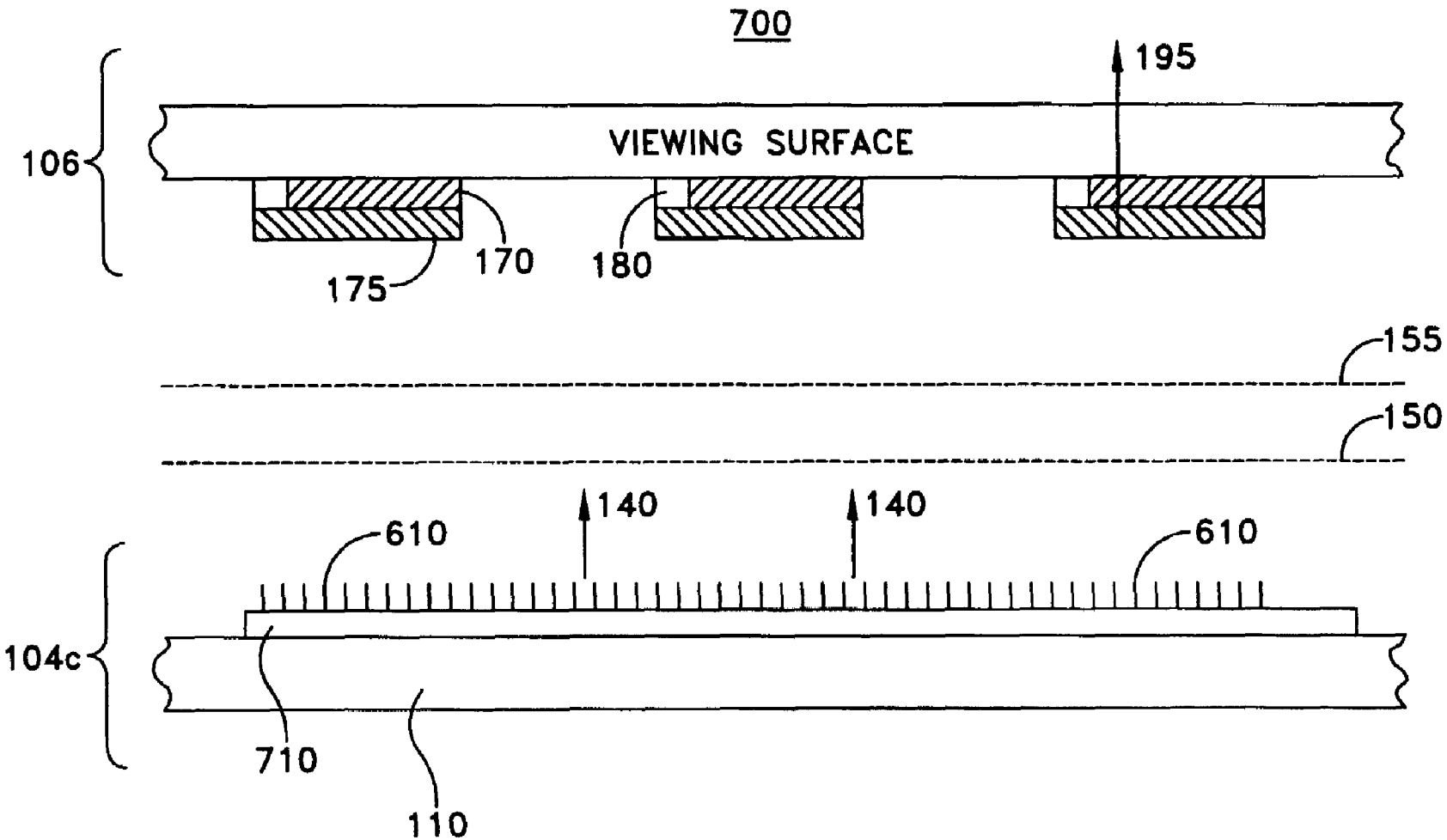
FIG. 7 illustrates a cross-sectional view of another embodiment of the TFT based display shown in FIG. 4 using an alternate cold cathode configuration.

FIG. 7 illustrates another exemplary embodiment of a TFT-cold cathode based display 700, wherein cathode 104*c* is composed of a plurality of carbon nanotubes 610 that are uniformly distributed on a conductive layer 710 on substrate 110. Grid 150 is also shown in this embodiment and is used for extracting electrons 140 emitted by nanotubes 610 and directed toward phosphor layer 175. In this embodiment, second grid 155 is included to decelerate electrons so that they are controllable by the TFT circuitry. Anode 106 is similar to that described with regard to FIG. 1 and its description need not be repeated.

Figure 8:
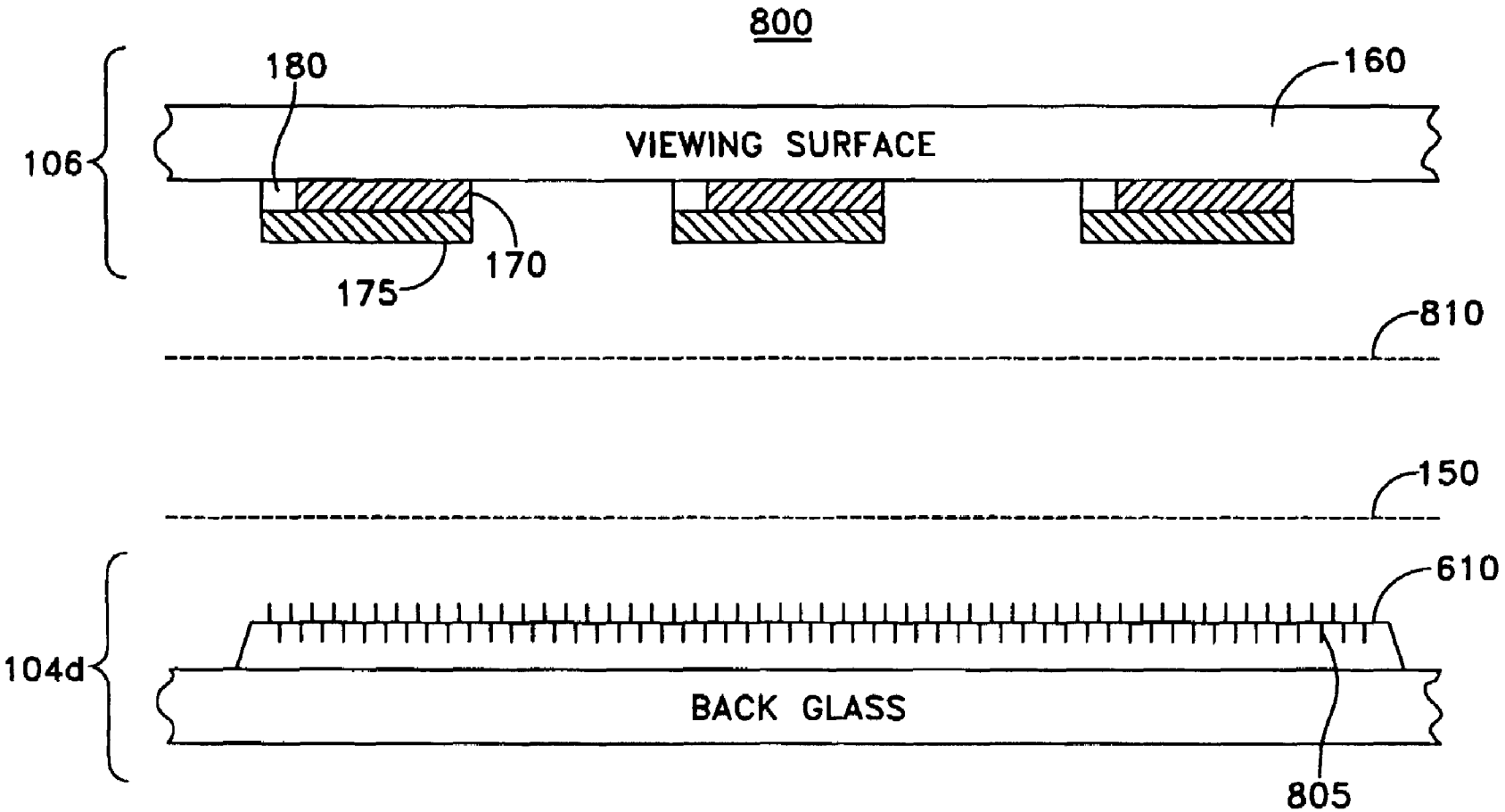
FIG. 8 illustrates a cross-sectional view of another embodiment of a TFT-cold cathode based display.

FIG. 8 illustrates an embodiment of a TFT-cold cathode based display 800 constructed similar to the display shown in FIG. 1, i.e., anode on viewing surface. In this embodiment, cathode 104*d* is composed of nanotubes 610 deposited on cathode filament 805. In this case, electrons are emitted from nanotubes 610 when a voltage difference between grid 150 and cathode filament 805 is sufficient to extract electrons 140. Grid 150 is located in the range of 100-200 microns above substrate 110. Second grid 810, which is used to decelerate electrons 140, is located between grid 150 and anode 106. Anode 106 is similar to that described with regard to FIG. 1 and its description need not be repeated.

Figure 9:
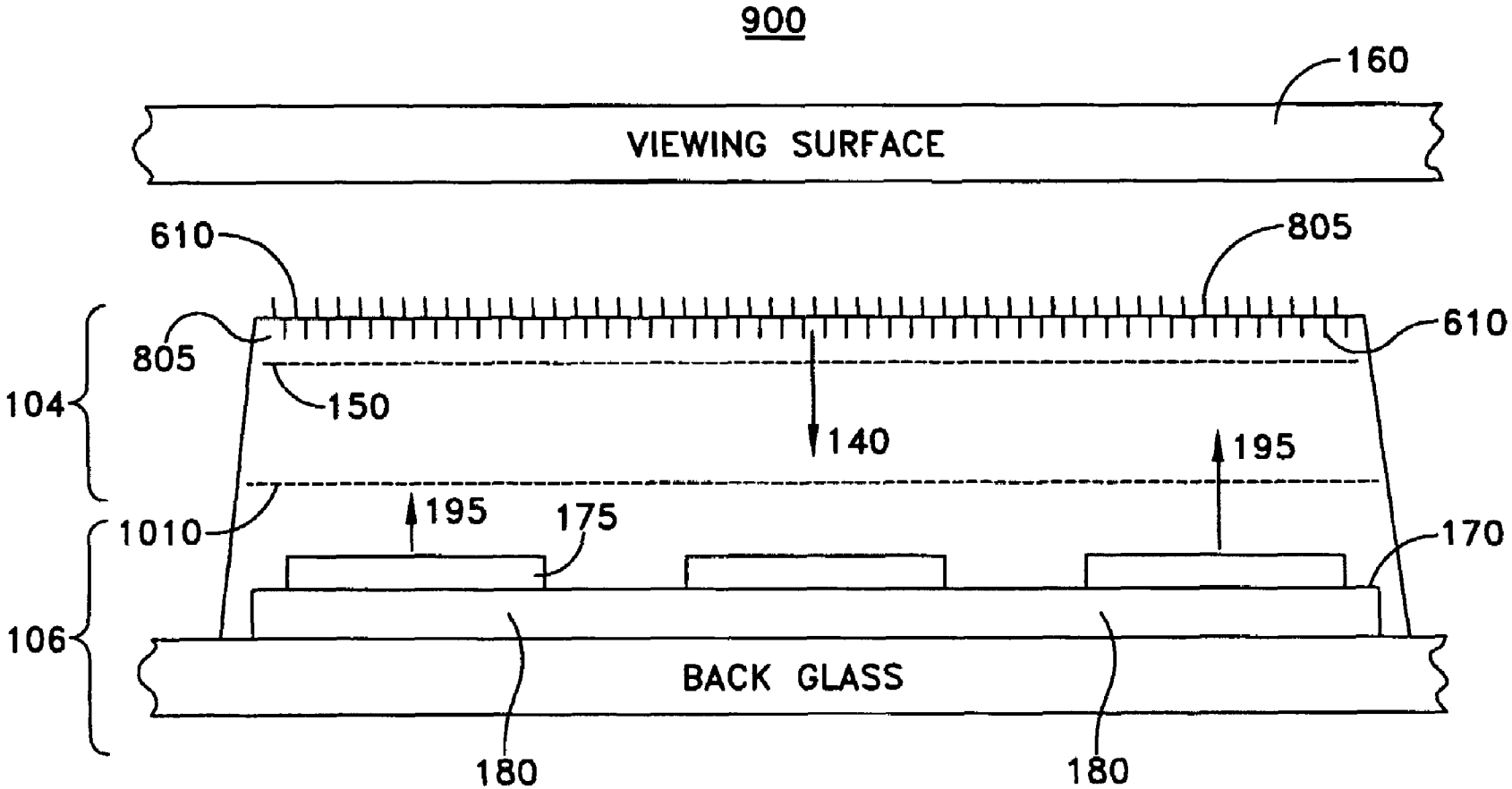
FIG. 9 illustrates a cross-sectional view of another embodiment of a TFT-cold cathode based display.

FIG. 9 illustrates another exemplary embodiment of a TFT-cold cathode based display 900 constructed similar to the display shown in FIG. 4, i.e., anode on back surface. In this embodiment, cathode 104 is composed of nanotubes 610 on cathode filament 805 as previously described, and grids 150 and 1010 are installed between nanotubes 610 and anode 106, to control and decelerate the flow of electrons to anode 106. Anode 106 is similar to that described with regard to FIG. 4 and its description need not be repeated.

Figure 10:
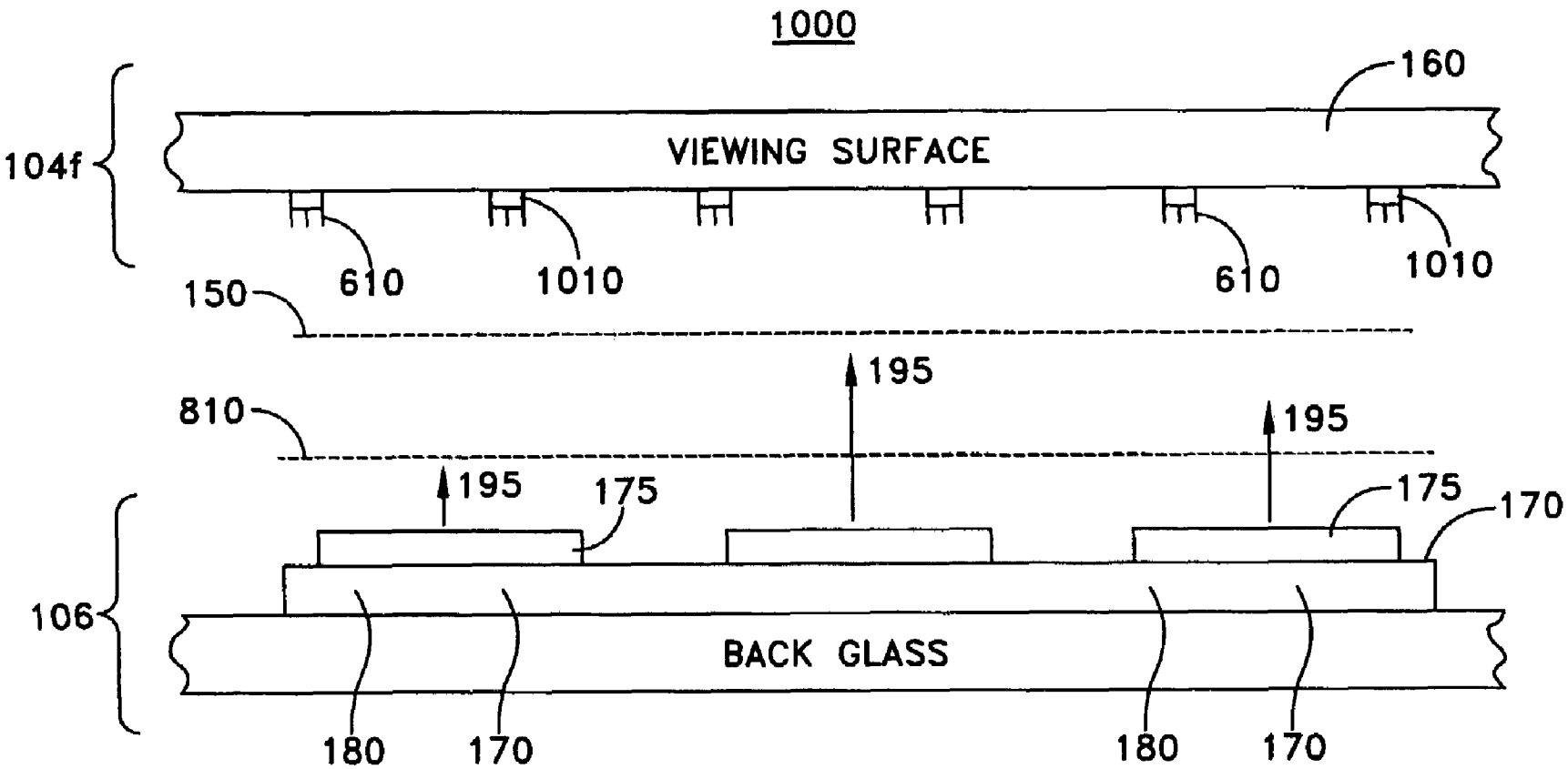
FIG. 10 illustrates a cross-sectional view of another embodiment of a TFT-cold cathode based display.

FIG. 10 illustrates an embodiment of a TFT-cold cathode based display 1000 constructed similar to the display shown in FIG. 4, i.e., anode on back surface. In this case, cathode 104*f* is composed of nanotubes 610 on narrow stripes of conductive layer 1010. The area occupied by these stripes is small and does not affect the image quality. Grids 150 and 810 are installed between cathode 104*f* and anode 106 to extract and control the flow of electrons 140 to anode 106. Grid 810 is used to decelerate the flow of electrons when the electron energies are too high to be controlled by the low anode voltage of the TFT circuit 180. Anode 106 is similar to that described with regard to FIG. 4 and its description need not be repeated.

Although not shown or discussed in detail, it would be understood by those skilled in the art that insulating spacers may be distributed throughout the display to electrically isolate the electrical potential applied to the elements disclosed, to separate two plates from each other and to sustain the evacuated pressure. It should be further understood that the spacers may be used to reduce glass plate thickness and thus decrease both weight and thickness of the display. It should also be understood that the edges of the overall display may be sealed and that the space between the cathode and the anode may be evacuated to a level of at least $10^{-5}$ torr.

Figure 11:
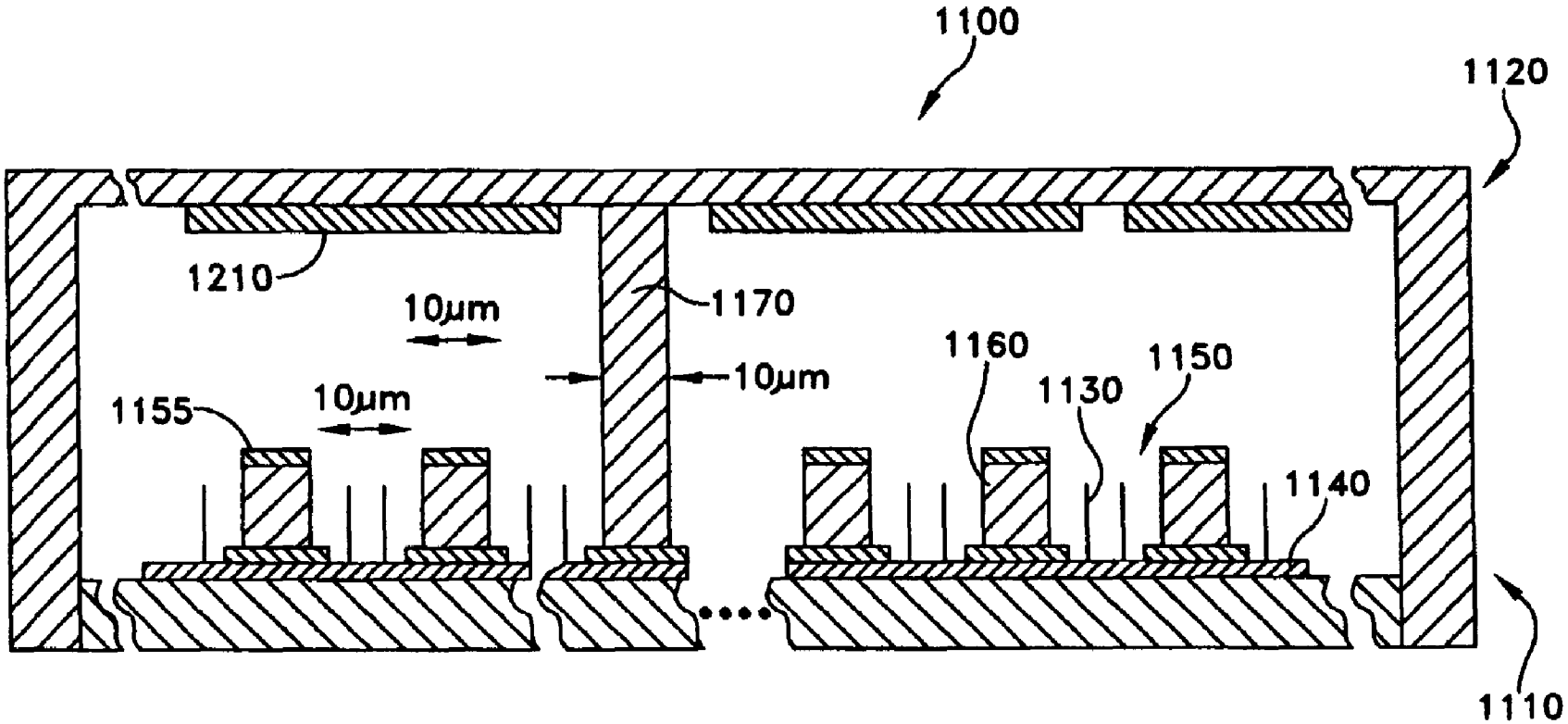
FIG. 11 illustrates a cross-sectional view of another embodiment of a TFT based display.

FIG. 11 illustrates an embodiment of a TFT based display 1100 according to an aspect of the present invention. Display 1100 includes a cathode 1110 and anode 1120. Cathode 1110 includes a plurality of carbon nanostructures 1130 cooperatively coupled to conductive material 1140 and located within wells 1150. Display 1100 further includes conductive layer 1155. In this case, conductive layer 1155, electrically isolated from material 1140 by insulator 1160, operates as a gate electrode that may be used to draw electrons from nanostructures 1130, when the potential difference between gate 1155 and nanostructures 1130 exceeds the threshold for electron extraction. Conductive layer 1155 may take the form of strips that define strips of wells 1150 (See FIG. 12). Insulator 1160 may take the form of SU-8 type photoresist and may be approximately 10 μm thick or tall for example. Display 1100 may include spacers 1170. Each spacer 1170 may be composed of an insulator, such as SU-8 type photoresist. Each spacer 1170 may be sufficiently thick or tall to maintain an operable separation between cathode 1110 and anode 1120, and may be on the order of about 10 μm wide. Display 1100 may or may not include one or more grids analogous to aforesaid grids 150 and/or 810. Anode 1130 may take a form similar to FIG. 1, including conductive pads and phosphor layers representative of individual pixel elements 1210, electrically conductive rows and columns 210, 220 and TFT circuits 180, such that its description need not be repeated.

Figure 12:
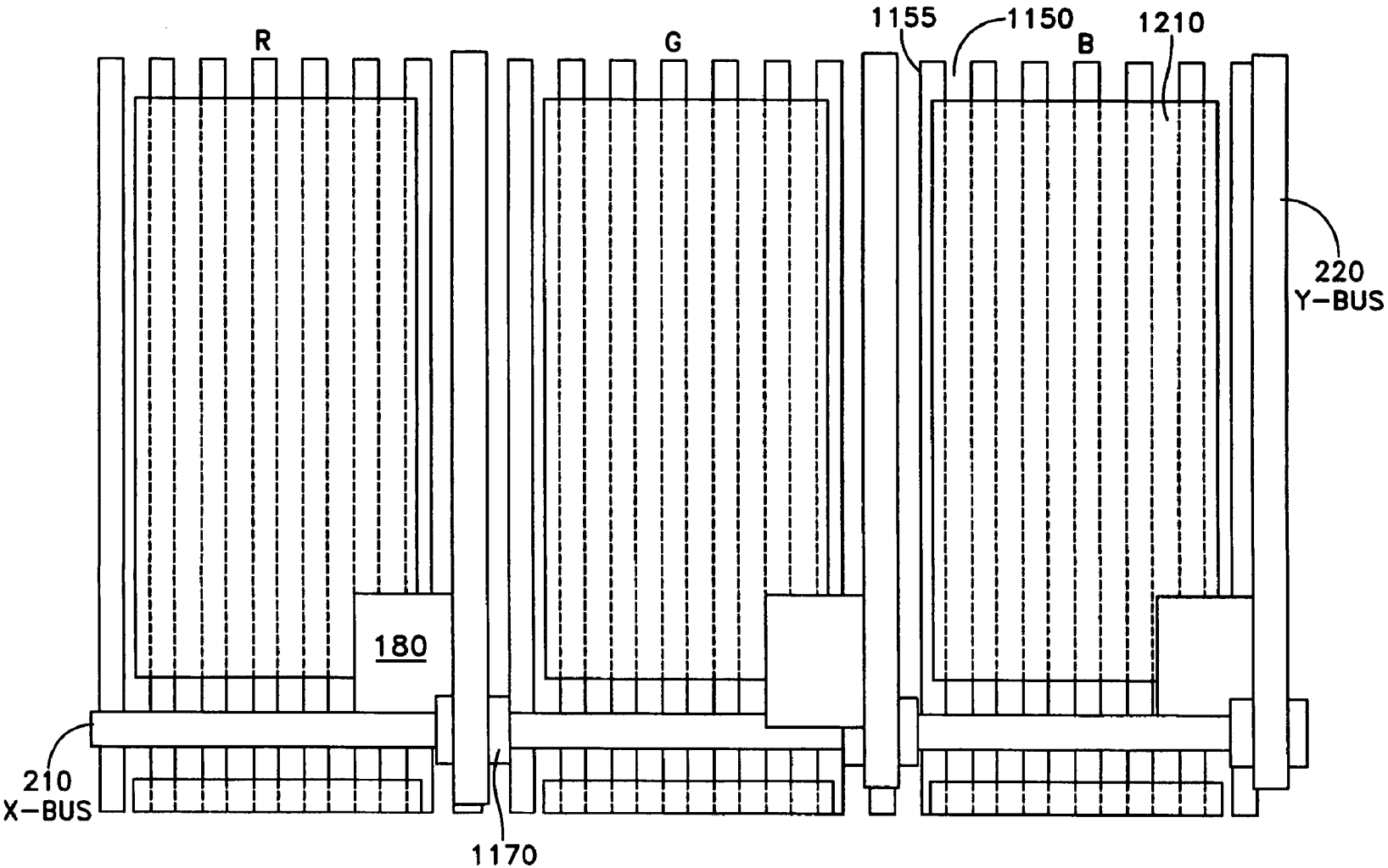
FIG. 12 illustrates a top or front view of the embodiment of FIG. 11.

Referring now also to FIG. 12, there is shown a top view of a portion of a display 1100 of FIG. 11. Pixels 1210, conductive rows and columns 210, 220, strips of gates 1155 and wells 1150, TFT circuits 180 and spacers 1170 may be seen therein. TFT circuits 180 may take the form described hereinabove with regard to FIG. 2.

Figure 13A:
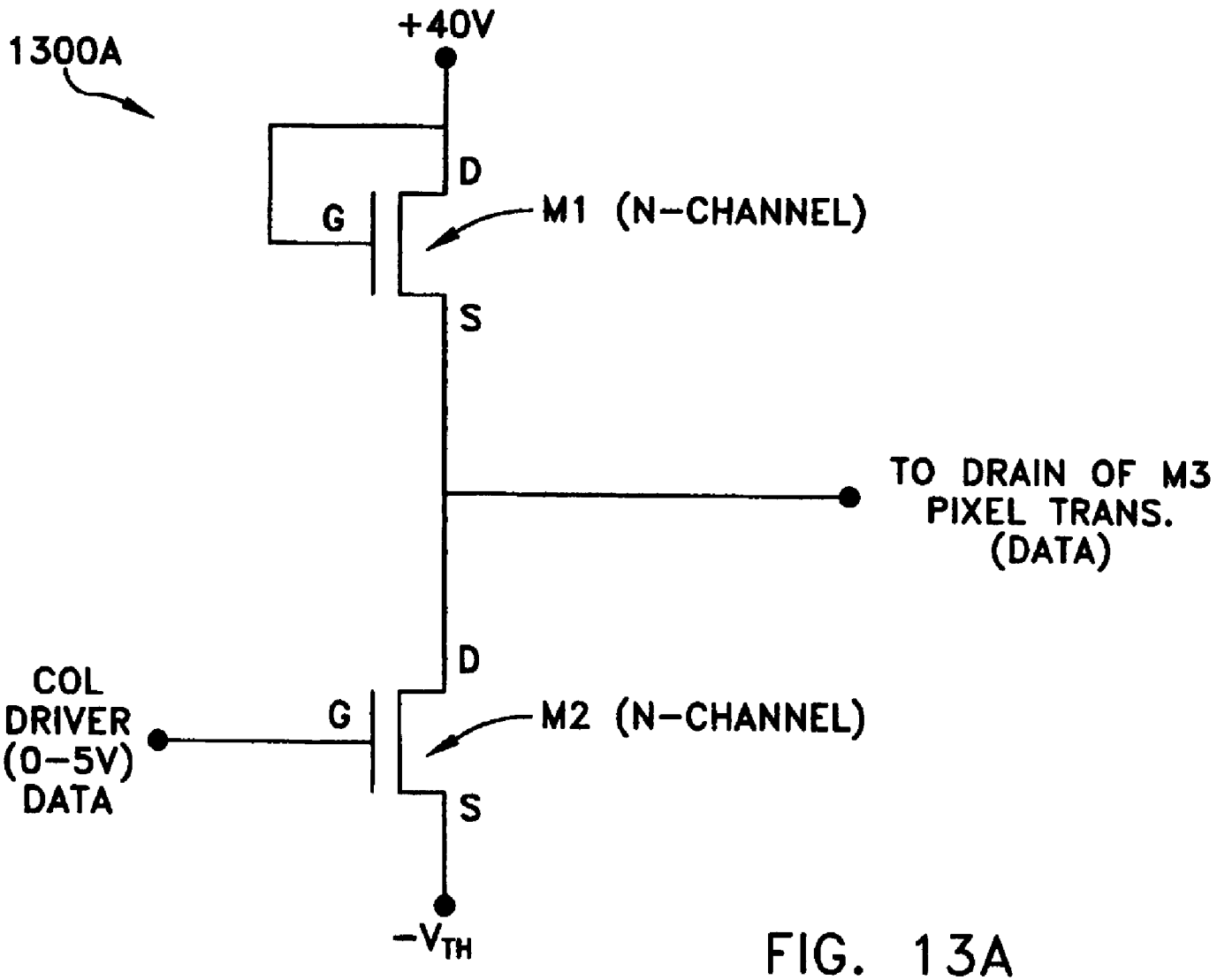
FIGS. 13A-13C illustrate schematic representations of various amplification stages suitable for use with the display of FIG. 11.
Figure 13B:
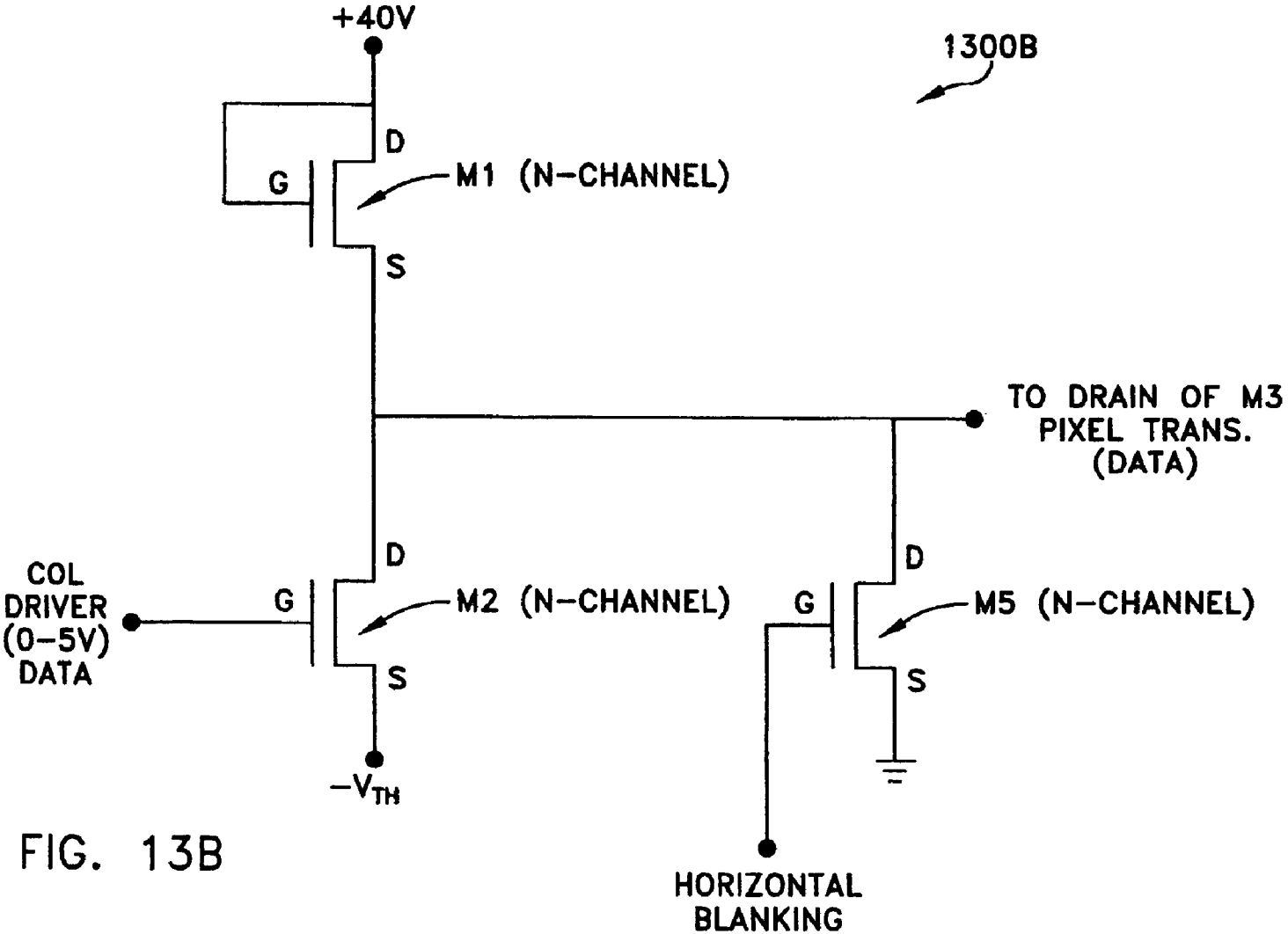
Figure 13C:
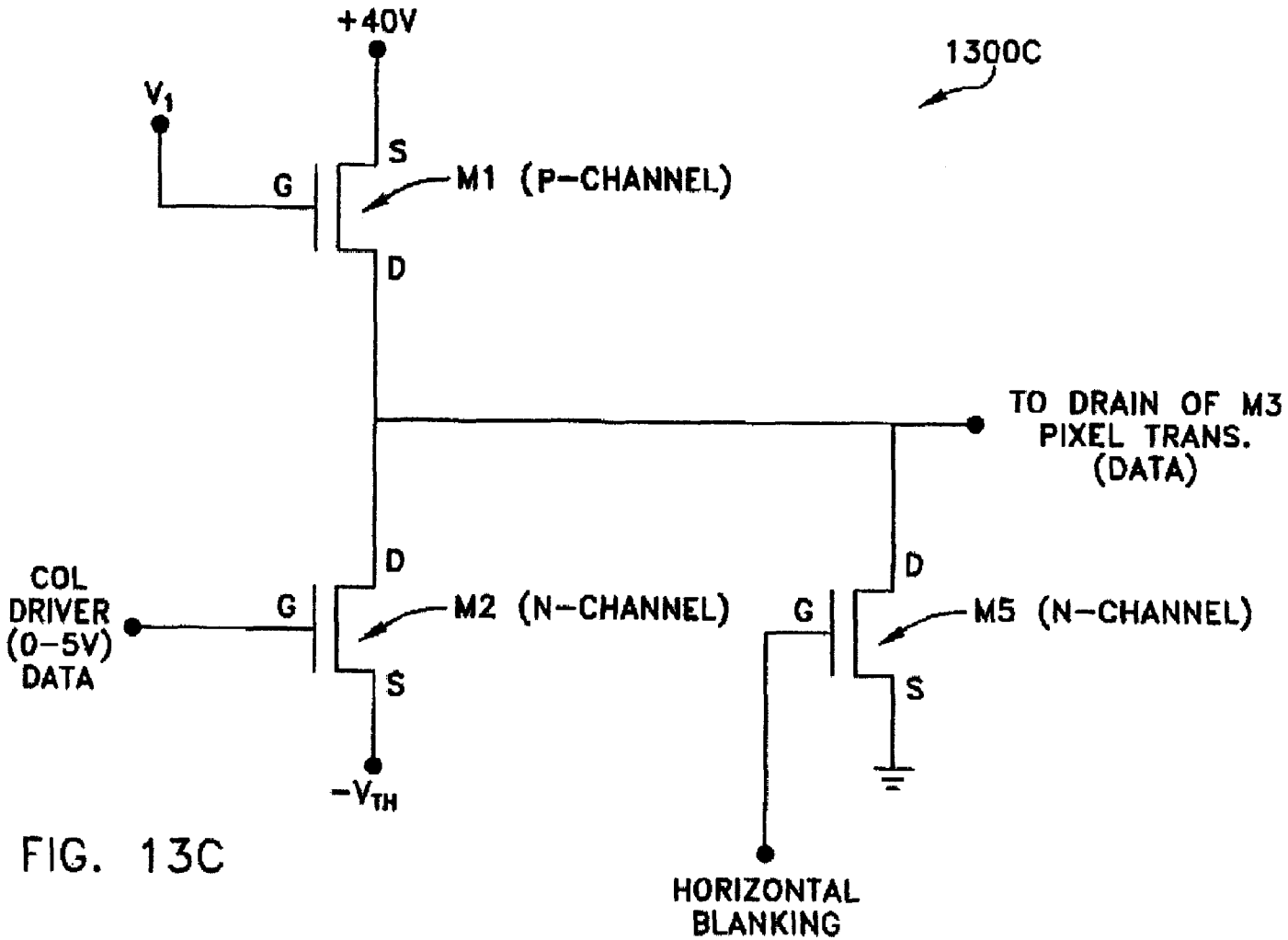
Figure 14:
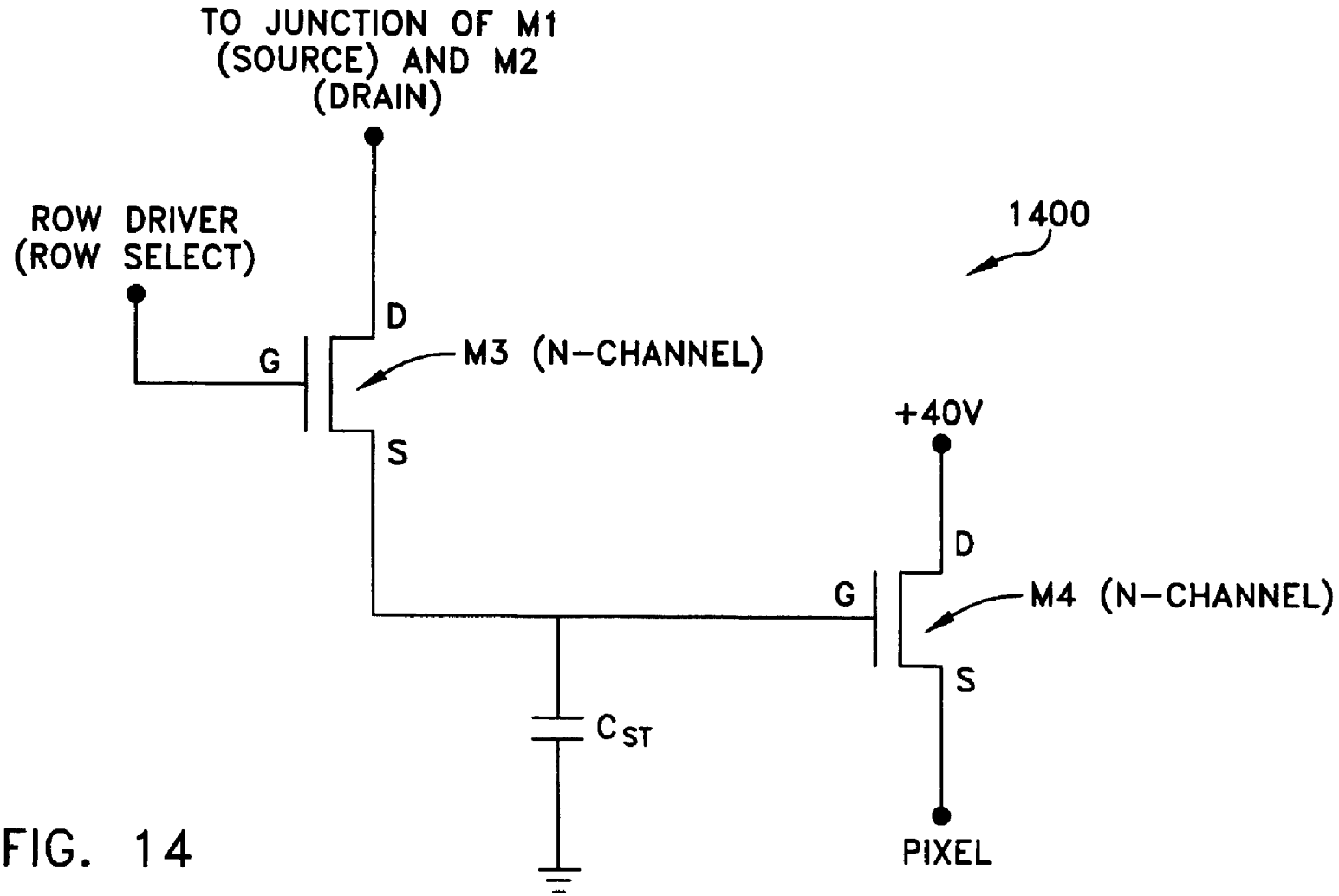
FIG. 14 illustrates a schematic representation of a pixel circuit stage suitable for use with the various amplification stages of FIGS. 13A-13C.

Alternatively, referring now also to FIGS. 13A-14, TFT circuits 180 may include an amplification stage (FIGS. 13A-13C) and a pixel circuit stage (FIG. 14). According to a first embodiment, a schematic circuit representation of a TFT amplification stage 1300A suitable for use in display 1100 of FIG. 11 is shown in FIG. 13A. Stage 1300A may be characterized as a two n-channel transistor configuration. Stage 1300A includes a first n-channel transistor M1 having gate and drain terminals coupled to a known voltage such as $V_{dd}$ or about +40V. A source terminal of transistor M1 is coupled to a drain terminal of a second n-channel transistor M2 and an input for the pixel circuit stage. A gate terminal of transistor M2 may have a column driver data signal, such as a 0-5V signal, provided thereon. A source terminal of transistor M2 may have another known voltage $V_{TH}$, such as about 3 to about 5 volts, provided thereon.

According to a second embodiment, a schematic circuit representation of a TFT amplification stage 1300B suitable for use in the display 1100 of FIG. 11 is shown in FIG. 13B. Stage 1300B may be characterized as a three n-channel transistor configuration. In operation, stage 1300B may serve to decrease discharge time of stray capacitance. Stage 1300B includes a first n-channel transistor M1 having gate and drain terminals coupled to a known voltage such as $V_{dd}$ or about +40V. A source terminal of transistor M1 is coupled to a drain terminal of a second n-channel transistor M2 and an input for the pixel circuit stage. A gate terminal of transistor M2 may have a column driver data signal, such as a 0-5V signal, provided thereon. A source terminal of transistor M2 may have another known voltage $V_{TH}$ or about 40V provided thereon. A third n-channel transistor M5 has a drain terminal coupled to the source terminal of transistor M1, the drain terminal of transistor M2 and the input to the pixel circuit stage. A gate terminal of transistor M5 may be selectively provided with a conventional horizontal blanking signal. A source terminal of transistor M5 may be grounded.

According to a third embodiment, a schematic circuit representation of a TFT amplification stage 1300C suitable for use in the display 1100 of FIG. 11 is shown in FIG. 13C. Stage 1300C may be characterized as a one p-channel, two n-channel transistor configuration. In operation, stage 1300C may serve to increase a realized output swing and power efficiency. Stage 1300C includes a p-channel transistor M1 having a source terminal coupled to a known voltage such as $V_{dd}$ or about +40V. A gate terminal of transistor M1 may be provided with another known voltage $V_1$, such as a voltage of about 36 or 37 volts, or a voltage less than about 40 volts. A drain terminal of transistor M1 is coupled to a drain terminal of a first n-channel transistor M2 and an input for the pixel circuit stage. A gate terminal of transistor M2 may have a column driver data signal, such as a 0-5V signal, provided thereon. A source terminal of transistor M2 may have another known voltage $V_{TH}$ provided thereon. A second n-channel transistor M5 has a drain terminal coupled to the drain terminal of transistor M1, the drain terminal of transistor M2 and the input to the pixel circuit stage. A gate terminal of transistor M5 may be selectively provided with a conventional horizontal blanking signal. A source terminal of transistor M5 may be grounded.

Referring now to FIG. 14, a schematic circuit representation of a pixel circuit stage 1400 suitable for use in the display 1100 of FIG. 11 is shown in FIG. 14. Stage 1400 may be characterized as a two n-channel transistor configuration. Stage 1400 includes a first n-channel transistor M3 having a drain terminal that serves as an input for stage 1400, i.e., may be coupled to the junction of the source terminal of transistor M1 and drain terminal of transistor M2 (FIGS. 13A-13C). A gate terminal of transistor M3 may have a row driver data signal provided thereon. A source terminal of transistor M3 is coupled to a gate terminal of a second n-channel transistor M4 and a capacitor $C_{ST}$, the capacitor $C_{ST}$ in turn coupled to ground. A drain terminal of transistor M4 is coupled to a known voltage such as $V_{dd}$ or about +40V. A source terminal of transistor M4 may be used as a pixel output signal, and be coupled to a pad 170 as has been described hereinabove. Stage 1400 may serve to provide a storage capacitance (i.e., memory), and provide a peak luminance (independent of frame time) rather than an average luminance, which is a function of frame time (i.e., the lower the frame time the lower the observed brightness will be).

Referring again to FIG. 11, Nanostructures 1130 may take the form of a plurality of nanotubes, such as single and/or multi wall carbon nanotubes, all by way of non-limiting example only. Nanostructures 1130 may take the form of an array of carbon nanotubes, such as a regular array, or a film of carbon nanotubes, also by way of non-limiting example only. Other nanostructures, such as nanofibers or sheets of nanofibers may also be suitable for use.

For non-limiting purposes of completeness, field emission is a process whereby an electric field is applied to a surface in order to extract electrons. Nanotubes are known to have excellent field emission properties. However, dense arrays of carbon nanotubes typically show suboptimal emission, due to shielding effects. It is believed that to overcome the shielding effect of dense nanotube arrays, it is important to control the diameter, length and site density. Methods to deposit nanotubes by screen printing, etc., have been proposed. This method scales well, but has the drawback of leaving nanotubes relatively unaligned on the substrate. Growing the nanotubes in an aligned manner in the correct density and geometry is believed to be preferable. To date, methods involving the use of electron-beam lithography, micro contact printing, shadow mask and other masking procedures have been proposed to make field emission devices. However, these procedures are generally expensive, slow, and scale poorly for mass production. Lastly, these processes cannot easily be conducted with nonplanar substrates. According to an aspect of the present invention, there may be provided a fast, inexpensive, and readily scalable process for use on planar, nonplanar or patterned substrates alike. Such a process for preparing carbon nanotube arrays uses electrochemical deposition to prepare catalytic nanoparticles for the growth of aligned carbon nanotubes. By adjusting the amplitude and duration of the pulse current, the density and size of the catalytic nanoparticles can be controlled. This technique permits control of the site density of the nanotube array. Tu et al. reported the use of this technique to nucleate carbon nanotubes, as is embodied in the U.S. Patent Publication No. 20040058153, the entire disclosure of which is incorporated by reference herein.

Figure 15:
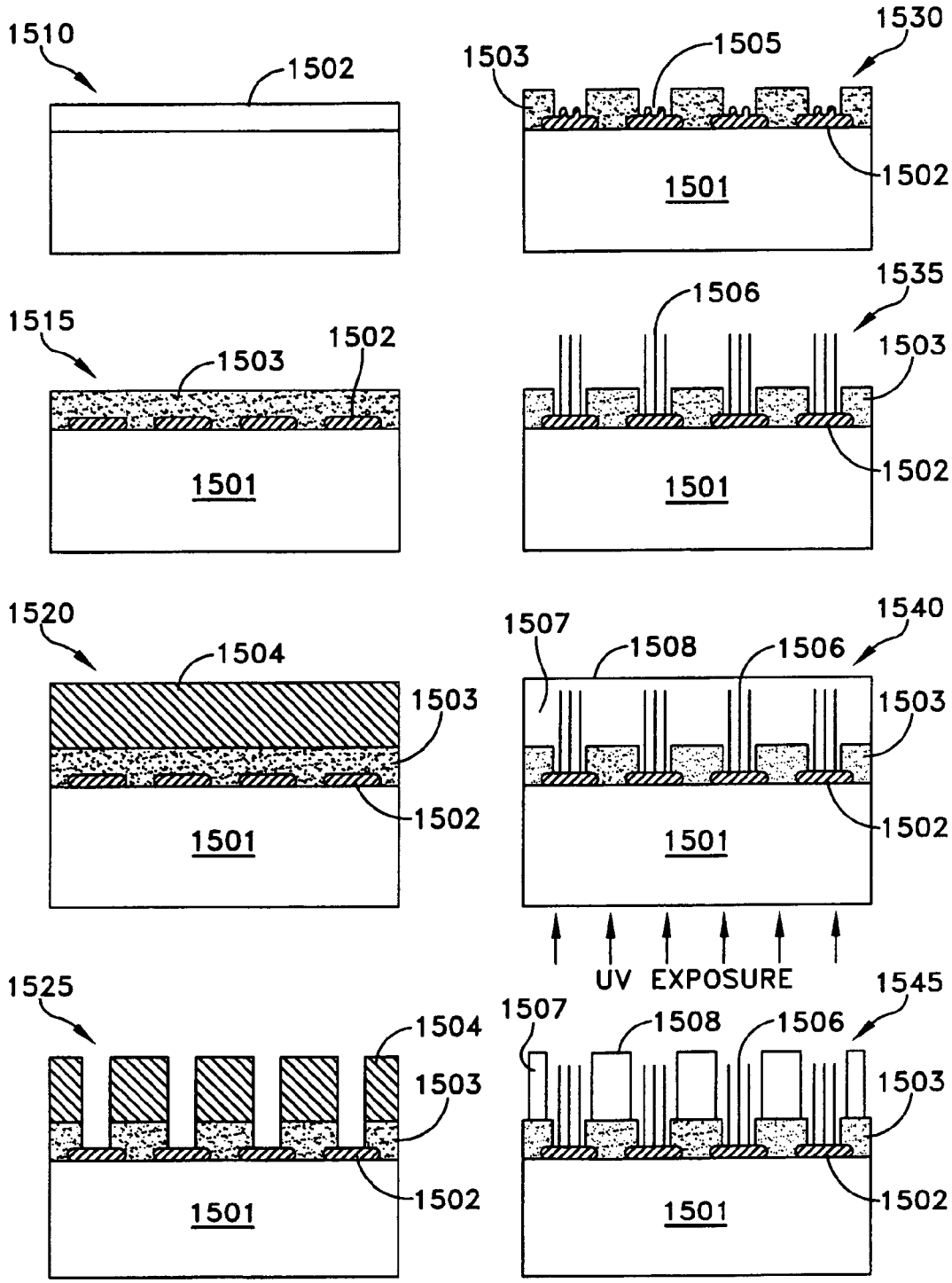
FIG. 15 illustrates a schematic representation of a cathode during various processing steps according to an aspect of the present invention.

Referring now also to FIG. 15, there is shown a cathode 1500 suitable for use as cathode 1110 of display 1100, in a series of processing steps. Referring first to step 1510, there is shown a substrate 1501 having a coating 1502. Substrate 1501 may take the form of any conventional substrate suitable for supporting the cathode of FIG. 15. In certain embodiments, it may be desirable that the substrate and coating appear transparent to a user, where an image is to be viewed through substrate 1501 and coating 1502. Substrate 1501 may take the form of a glass substrate. Coating 1502 may take the form of chromium. Coating 1502 may be about 100 nm thick. A resist coating may be spun onto coating 1502. The resist may be patterned, such as by photolithographic processing, to provide alternating rows of photoresist and exposed chromium that will correspond to rows of gate electrodes and wells as has been described with regard to FIGS. 11 and 12. The chromium may then be etched to remove the exposed portions.

Referring now also to step 1515, a layer 1503 of $SiO_x$, such as $SiO_2$, may be deposited onto the patterned coating 1502. Layer 1503 may be at least about 0.1 μm thicker than coating 1502, to provide for insulation between what will become the cathode conductors and gate electrodes as has been discussed with regard to FIG. 11. Referring now also to step 1520, a positive resist layer 1504, such as photoresist, may be spun coat onto layer 1503. Layer 1504 may be about 1 μm thick, for example. Layer 1504 may be patterned, again using photolithographic techniques for example, to provide openings roughly aligned with the remaining portions of layer 1502. The patterned openings may be slightly smaller than the remaining portions of layer 1502, by way of non-limiting example.

Referring now also to Step 1525, patterned or exposed portions or regions of layer 1503 may be removed, such as by buffered HF selective etching for example, to reveal at least portions of the remaining layer 1502.

Referring now also to Step 1530, a catalytic layer 1505 may be deposited onto the exposed portions of layer 1502. Catalytic layer 1505 may include iron, cobalt or nickel, by way of non-limiting example only. Layer 1505 may be substantially uniform or may be patterned for example. By way of further non-limiting example only, layer 1505 may be deposited using amplitude and duration controlled pulse-current electrochemical deposition to form nanoparticles on layer 1502. Formed nanoparticles may typically be less than about 100 nm in size. Formed nanoparticles may have a density between about $10^6$ and $10^8/cm^2$.

Referring now also to Step 1535, nanostructures 1506 may be formed on catalytic layer 1505. Nanostructures 1535 may take the form of aforementioned nanostructures 1130 (FIG. 11). Thus, nanostructures 1506 may take the form of self aligned arrays of carbon nanotubes. Nanotubes may be formed on catalytic layer 1505 using any suitable methodology, such as that described in U.S. Patent Publication No. 20040058153.

Referring now also to Step 1540, a resist coating layer 1507, such as a 10 μm thick layer of SU-8 photoresist, may be spun over nanostructures 1506 and layer 1503—to provide a standoff distance for the gate electrodes. Resist layer 1507 may then be exposed, such as to UV through substrate 1501. A post exposure baking step may also be effected. A metallization layer 1508 may be deposited upon layer 1507. Metallization layer 1508 may be composed of chromium, for example. Layer 1508 may eventually form the gate electrodes of FIG. 11 and be about 50 nm thick, for example.

Figure 15A:
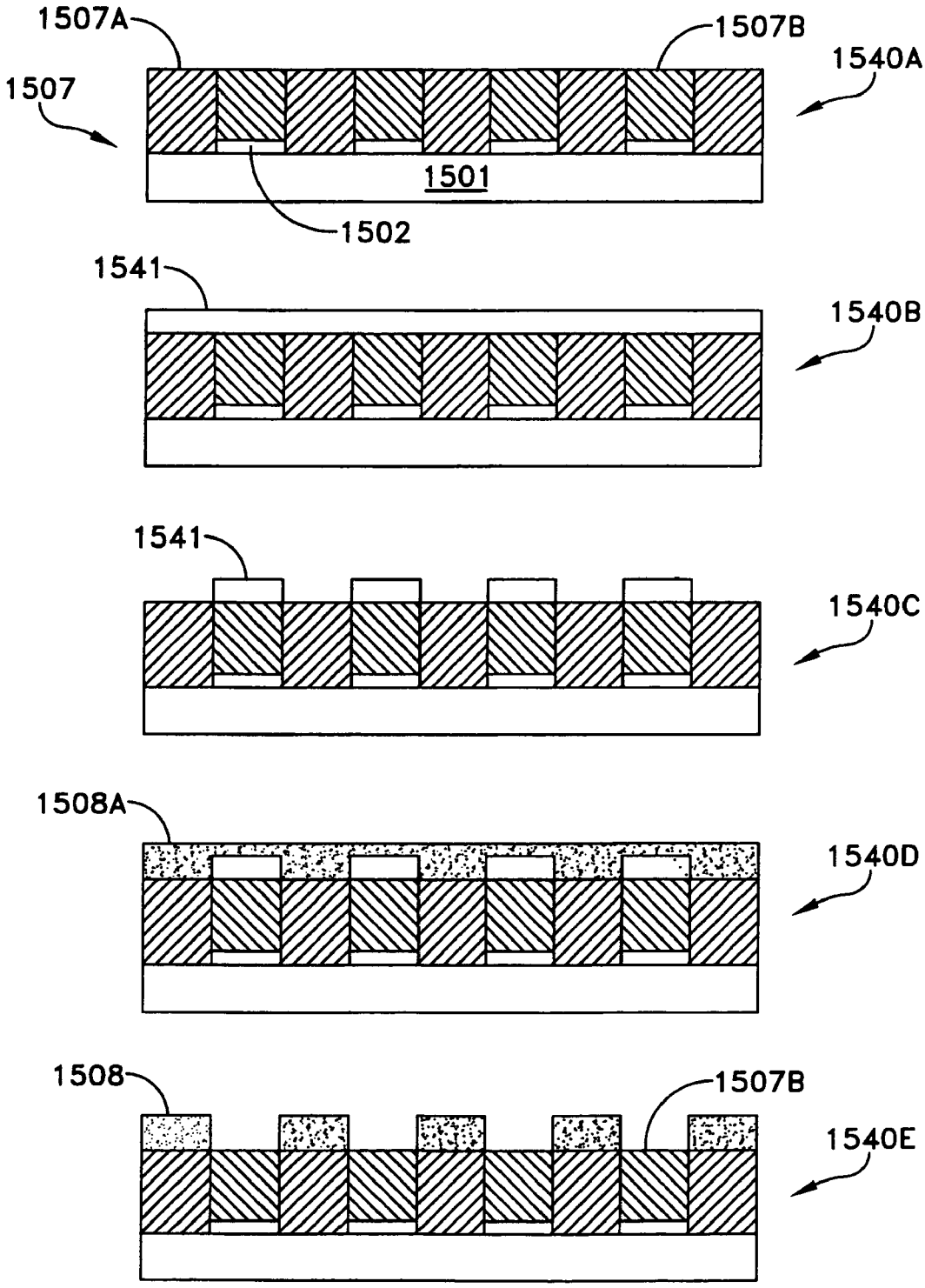
FIG. 15A illustrates a schematic representation of a cathode during various processing steps according to an aspect of the present invention.

Referring now also to FIG. 15A, there is shown a process for gate formation suitable for use with process 1500. Steps 1540A-1540E may provide for step 1540. In step 1540A, there is shown substrate 1501, layer 1502 patterned in conductive islands and resist layer 1507. Emitting structures, such as nanotubes, may already be formed on the patterned islands of coating 1502. Resist layer 1507 may take the form of SU-8 photoresist. Layer 1507 may be exposed through substrate 1501 to yield cross-linked SU-8 regions 1507A and non-cross-linked regions 1507B. As will be understood by those possessing an ordinary skill in the pertinent arts, the positioning of regions 1507A and 1507B is dependent upon patterned coating 1502, as layer 1507 is cured through the substrate such that patterned coating 1502 serves as a mask.

Referring now also to step 1540B, a layer 1541 of photoresist may be deposited onto the construction of step 1540A. The photoresist of layer 1541 may have improved lift-off operability as compared to the resist of layer 1507. Layer 1541 may be composed of 1805 photoresist, for example. The 1805 photoresist may be spun onto the construct of step 1540A. Referring now also to step 1540C, layer 1541 may be back-exposed and developed, and thereby patterned. Again, as will be understood by those possessing an ordinary skill in the pertinent arts, via back-exposing the pattern of layer 1541 is dependent upon the pattern of conductive islands of layer 1502.

Referring now also to step 1540D, a metallization layer 1508A may be deposited over the construct of step 1540C. Layer 1508A may be composed of chromium, for example. Referring now also to step 1540E, the construct of step 1540D may then be subjected to a lift-off process, such as through the use of a developer like MF-319 or acetone—thereby providing metallization layer 1508.

Referring again to FIG. 15, and now to step 1545, layer 1507 (1507B in FIG. 15A) may be developed to expose nanostructures 1506. The composite structure may then be hard baked.

Processing consistent with that described with reference to FIGS. 15 and 15A provides a composite structure having chromium gate electrodes (layer 1508) upon hard baked SU-8 photoresist standoffs (layer 1507) and nanostructures (layer 1506) upon chromium layer (1502) within wells between gate electrodes. The wells in the SU-8 layer (1507) may be wider than the exposed chromium stripes thus providing insulation and serving to mitigate a risk of shorts and leaks as the edges of the chromium stripes are covered by $SiO_x$ (layer 1503).

The resulting composite structure may be used as an electron source that may be assembled with a TFT anode matrix, as has been discussed herein throughout, to provide a FED. Advantageously, such a display may not require a focusing electrode and therefore may permit the gap between the anode (TFT) and cathode (composite structure of FIG. 15) requiring only a low anode voltage.

Referring again to FIG. 11, SU-8 phototoresist may be used to form spacers 1170 in vacuum display. Without these spacers, the display glass may need to be sufficiently thick to withstand the force of atmospheric pressure. An array of spacers 1170 between the front and back glass, uniformly distributed within the vacuum space, permits the use of thinner glass, that results in unlimited display size.

According to an aspect of the present invention, SU-8 photoresist material can be patterned to a thickness as high as 2 mm with an aspect ratio of 20:1. Suitable spacer dimensions may be about 200×20×20 μm which results in a 10:1 aspect ratio. 20 μm×20 μm spacers are also not be visible by the human eye. FIG. 11 shows three spacers 1170 between the bottom and top glass, i.e., anode and cathode, for non-limiting illustrative purposes only. To avoid breakdown or leakage through the spacer 1170, at least one end of each spacer 1170 may be attached either to the display glass or an insulator. Typical distance between the spacers in the array may be about 2-5 mm.

Figure 16:
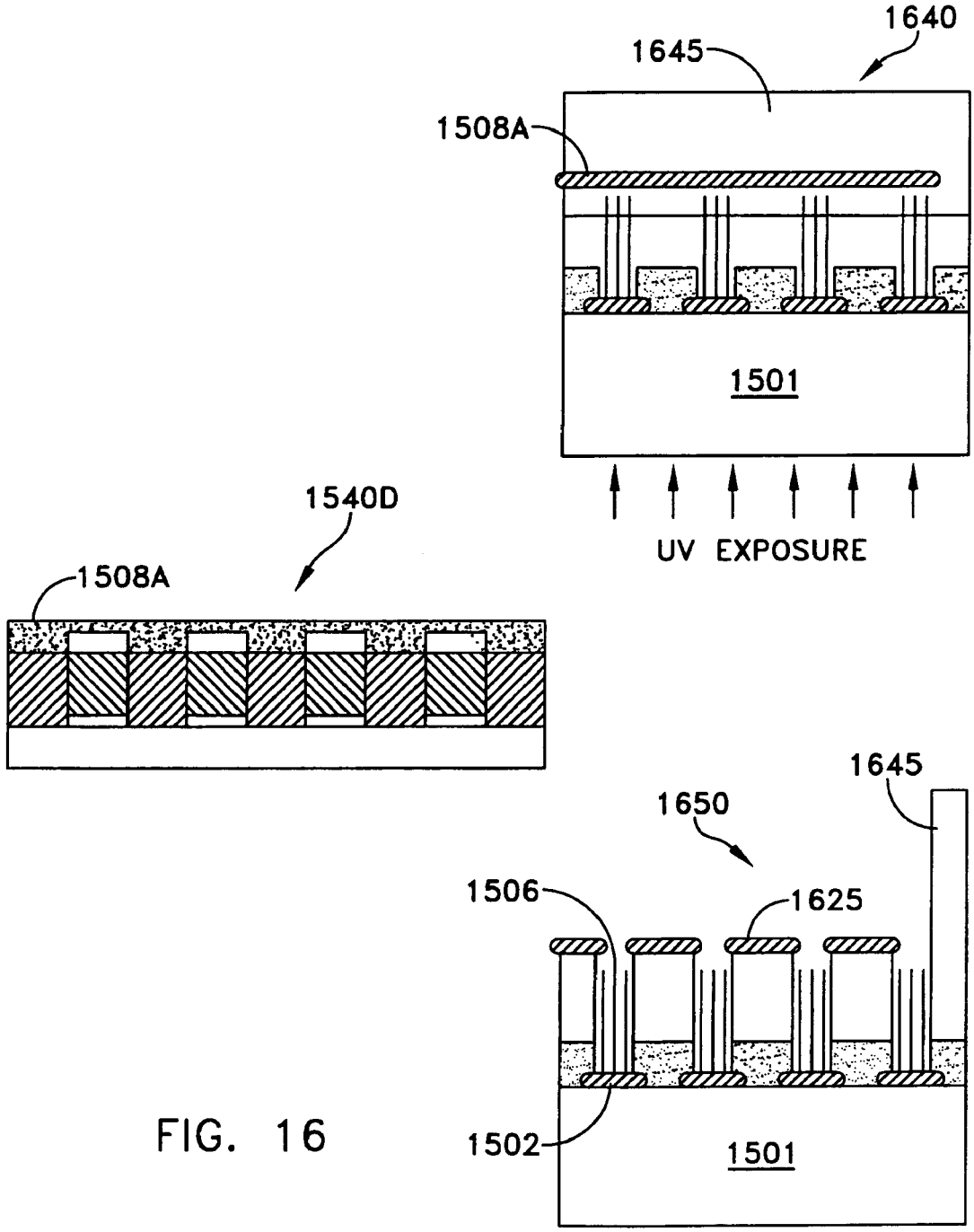
FIG. 16 illustrates a schematic representation of a cathode during various processing steps according to an aspect of the present invention; and, FIG. 17 illustrates a schematic representation of a cathode during various processing steps according to an aspect of the present invention.

To form a display including spacers, and referring now to FIGS. 15, 15A and 16, processing may proceed as follows. A positive resist 1635 may be spin coated onto layer 1508A. Resist 1635 may be about 1 μm thick, for example. Resist 1635 may be patterned in a conventional manner to expose space(s) in Cr layer 1508A corresponding to the spacers 1170 (FIG. 11). The Cr layer may then be etched. Referring now also to Step 1640, an about 200 nm thick coating of Su-8, such as Su-8-100, may be spun on as layer 1645. Referring now also Step 1640, the Su-8-100 layer 1645 may be developed, such as through the substrate 1501. Referring now also to step 1650, developed portions or regions may be removed to provide a cathode suitable for use as the cathode 1110 of display 1100 (FIG. 11).

Figure 17:
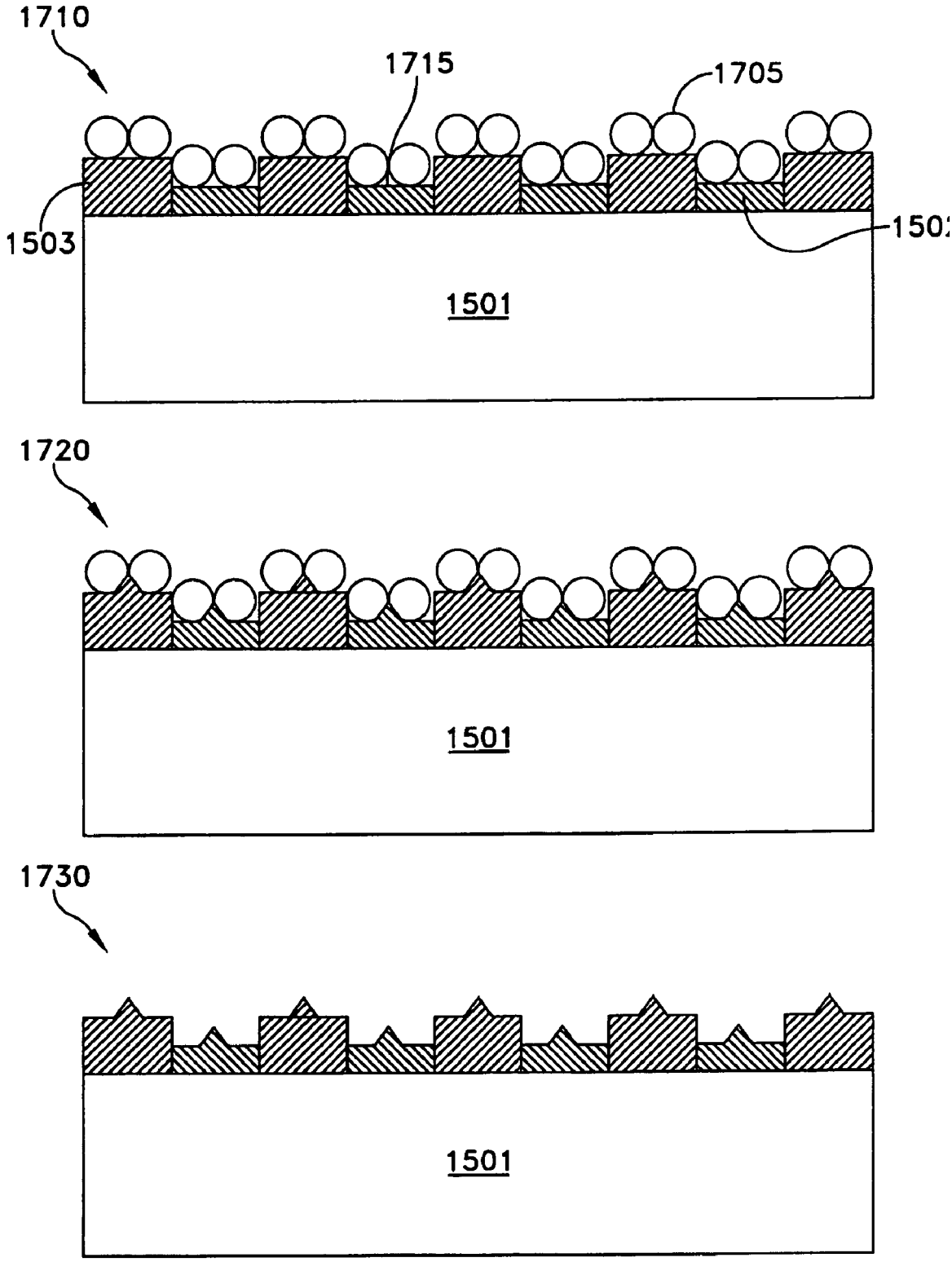

Referring now also to FIG. 17, there is shown an alternative processing according to an aspect of the present invention. To utilize the processing of FIG. 17, after Step 1525 (FIG. 15), processing may proceed as follows. Referring now to Step 1710, a layer of nanoparticles 1705 may be deposited upon layers 1502, 1503 (FIG. 15). Layer 1705 may take the form of a monolayer of nanospheres. The spheres may be about 2 μm in diameter, for example. The spheres may be largely composed of polystyrene, for example. Layer 1705 may be formed using any conventional technique. Layer 1705 forms open spaces 1715, in a hexagonal pattern, for example. The density of the open spaces may be controlled through the use of additional monolayers of spheres, for example. According to an aspect of the present invention, the density of spaces may be about $10^5/cm^2$ to about $10^9/cm^2$, or around about $10^6/cm^2$.

Referring now to Step 1720, a catalyst, such as nickel, may be deposited or sputtered over the layer 1705, such that it coats the spheres of layer 1705 and spaces 1715. Referring now also to Step 1730, layer 1705 may then be dissolved or selectively removed. This may be accomplished using a solvent that does not attack either Cr or Ni. Processing may then proceed as shown in FIG. 15, commencing with Step 1535 (FIG. 15).

Turning now to another aspect of the present invention, amorphous-Si (α-Si) circuitry may commonly be used in TFT circuitry. This approach however may not conventionally be well suited for vacuum-based devices, since vacuum sealing procedures may typically require temperatures above 400 C to be held for a few hours. At these temperatures, a significant degradation of the α-Si TFT circuit may occur. This may present a significant hurdle in obtaining commercially desirable yields of TFT anodes in vacuum devices.

According to an aspect of the present invention, and to overcome this problem, low temperature vacuum sealing may be used. Epoxies suitable for sealing at temperatures around 100-120 C and having a low outgassing effect may be used as a sealing material. As an example, a VS-101 epoxy, such as that commercially available from Huntington Labs, of Mountain View, Calif. may be suitable for low temperature sealing.

Before assembling and sealing, major elements of the construction, including phosphor, may be annealed in a vacuum at a high temperature to minimize the outgassing effect after sealing. Care may be also taken to provide a large getter area in the vacuum chamber and thus maintain the vacuum over a long period of device operation.

According to an aspect of the present invention, the following methodology for low temperature sealing may be used. First, a display housing may be pumped out at room temperature. The housing may then be heated, for example at a rate of about 1° C./minute, to 95° C. while pumping is maintained. One may expect the vacuum to degrade due to outgassing. Pumping and heating may be maintained until after some period of time, such as for example about 3 to 3.5 hours, the vacuum improves to pre-heating conditions. The temperature may then be returned to room temperature, such as over the course of about an hour.

According to an aspect of the present invention, where a thermionic filament is used for electron emission, the element may be excited, such as by about 12.5 V for example. Again, this may cause the vacuum to degrade. A higher excitation level may then be applied to the thermionic filament, such as on the order of about 15 volts. One may observe that the filament is red and uniform for example. The filament excitation may then be removed. According to an aspect of the present invention, other electron emitters may be excited in suitable manners.

According to an aspect of the present invention, one may then excite the anode, columns and rows by applying a voltage of about 39 volts thereto, for example. The filament may then be excited again, using a voltage of around 8 volts, for example. Again, one may expect the vacuum to degrade due to outgassing. However, after a period of time, such as about one hour, the vacuum will improve. After a longer period of time, such as about 2 hours, the vacuum will return to normal and outgassing is complete, such that the housing may be sealed by heating and compressing sealing tubing.

Low temperature sealing may also be used with other types of electron emission devices as well. Vacuum Fluorescent Devices utilizing hot cathode filaments as electron emitters may also utilize TFT circuitry. According to an aspect of the present invention, sealing such a device at low temperature will better accommodate use of α-Si based TFT technology with hot cathode emitters, by way of further non-limiting example.

While there has been shown, described, and pointed out fundamental novel features of the present invention as applied to preferred embodiments thereof, it will be understood that various omissions and substitutions and changes in the apparatus described, in the form and details of the devices disclosed, and in their operation, may be made by those skilled in the art without departing from the spirit of the present invention. It is expressly intended that all combinations of those elements that perform substantially the same function in substantially the same way to achieve the same results are within the scope of the invention. Substitutions of elements from one described embodiment to another are also fully intended and contemplated.

What is claimed is:

1. A field emission display comprising:

an anode comprising a matrix of pixels; and, a cathode comprising:

an insulating layer defining a plurality of wells having a conductor therein;

a first conductive layer forming a plurality of conductive pads, each of said conductive pads corresponding to one of said wells;

a plurality of nanostructures electrically coupled to said conductive pads;

a second conductive layer formed over said insulating layer and providing a plurality of gate electrodes;

driver circuitry comprising:

first and second n-channel transistors, the first n-channel transistor having gate and drain terminals coupled to a given voltage, and a source terminal coupled to a drain terminal of the second n-channel transistor; and, the second n-channel transistor has a gate terminal for providing a column driver data signal and a source terminal coupled to another given voltage; and a third n-channel transistor having a drain terminal coupled to the source terminal of the first n-channel transistor and the drain terminal of the second n-channel transistor and the input to the pixel circuit stage; wherein a gate terminal of the third n-channel transistor is selectively provided with a horizontal blanking signal and a source terminal of the third n-channel transistor is substantially grounded;

wherein, when a potential between said conductive pads and gate electrodes exceeds a threshold voltage, said nanostructures emit electrons that impinge said pixels.

2. The display of claim 1, wherein at least one of said first and second conductive layers comprise nickel.

3. The display of claim 1, wherein at least one of said first and second conductive layers comprise chromium.

4. The display of claim 1, wherein said nanostructures comprise carbon nanotubes.

5. The display of claim 4, wherein said carbon nanotubes are arranged in a regular array upon said pads.

6. The display of claim 1, further comprising a plurality of spacers interposed between said anode and cathode.

7. The display of claim 6, wherein said spacers comprise an insulator.

8. The display of claim 6, wherein said spacers comprise a photoresist.

9. A field emission display comprising:

an anode comprising a matrix of pixels, wherein each pixel has associated therewith driver circuitry comprising first, second and third transistors, wherein:

the first transistor has gate and drain terminals coupled to a given voltage, and a source terminal coupled to a drain terminal of the second transistor;

the second transistor has a gate terminal for providing a column driver data signal and a source terminal coupled to another given voltage; and, the third transistor has a gate terminal for providing row driver data signal and a drain terminal coupled to the source terminal of the first transistor and the drain terminal of the second transistor; and a cathode comprising:

an insulating layer defining a plurality of wells having a conductor therein;

a first conductive layer forming a plurality of conductive pads, each of said conductive pads corresponding to one of said wells;

a plurality of structures electrically coupled to said conductive pads; and a second conductive layer formed over said insulating layer and providing a plurality of gate electrodes;

wherein, when a potential between said conductive pads and gate electrodes exceeds a threshold voltage, said structures emit electrons that impinge said pixels.

10. A field emission display comprising:

an anode comprising a matrix of pixels; and, a cathode comprising;

an insulating layer defining a plurality of wells having a conductor therein; a first conductive layer forming a plurality of conductive pads, each of said conductive pads corresponding to one of said wells;

a plurality of nanostructures electrically coupled to said conductive pads;

a second conductive layer formed over said insulating layer and providing a plurality of gate electrodes;

driver circuitry comprising:

a p-channel transistor having a source terminal coupled to a given voltage, a gate terminal coupled to another given voltage;

a first n-channel transistor having a drain terminal coupled to a drain terminal of the p-channel transistor, a gate terminal having a column driver data signal provided thereon, and a source terminal having a third given voltage provided thereon;

a second n-channel transistor having a drain terminal coupled to the drain terminal of the p-channel transistor and the drain terminal of first n-channel transistor, a gate terminal selectively provided with a horizontal blanking signal, and a substantially grounded source terminal.

11. A field emission display comprising:

an anode comprising a matrix of pixels; and, a cathode comprising:

an insulating layer defining a plurality of wells having a conductor therein; a first conductive layer forming a plurality of conductive pads, each of said conductive pads corresponding to one of said wells;

a plurality of structures electrically coupled to said conductive pads;

a second conductive layer formed over said insulating layer and providing a plurality of gate electrodes;

driver circuitry comprising:

first and second n-channel transistors, the first n-channel transistor having gate and drain terminals coupled to a given voltage, and a source terminal coupled to a drain terminal of the second n-channel transistor; and, the second n-channel transistor has a gate terminal for providing a column driver data signal and a source terminal coupled to a given voltage; and a third n-channel transistor having a drain terminal coupled to the source terminal of the first n-channel transistor and the drain terminal of the second n-channel transistor and the input to the pixel circuit stage; wherein a gate terminal of the third n-channel transistor is selectively provided with a horizontal blanking signal and a source terminal of the third n-channel transistor is substantially grounded;

wherein, when a potential between said conductive pads and gate electrodes exceeds a threshold voltage, said stuctures emit electrons that impinge said pixels.

12. A field emission display comprising:

an anode comprising a matrix of pixels; and, a cathode comprising:

an insulating layer defining a plurality of wells having a conductor therein; a first conductive layer forming a plurality of conductive pads, each of said conductive pads corresponding to one of said wells;

a plurality of structures electrically coupled to said conductive pads;

a second conductive layer formed over said insulating layer and providing a plurality of gate electrodes;

driver circuitry comprising:

a p-channel transistor having a source terminal coupled to a given voltage, a gate terminal coupled to another given voltage;

a first n-channel transistor having a drain terminal coupled to a drain terminal of the p-channel transistor, a gate terminal having a column driver data signal provided thereon, and a source terminal having another given voltage provided thereon; a second n-channel transistor having a drain terminal coupled to the drain terminal of the p-channel transistor and the drain terminal of first n-channel transistor, a gate terminal selectively provided with a horizontal blanking signal, and a substantially grounded source terminal.

* * * * *